US011905084B2

(12) United States Patent
Watkins

(10) Patent No.: US 11,905,084 B2
(45) Date of Patent: Feb. 20, 2024

(54) APPARATUS FOR FACILITATING DISPENSING PAYLOADS INTO A CONTAINER

(71) Applicant: Barton Wood Watkins, Knoxville, TN (US)

(72) Inventor: Barton Wood Watkins, Knoxville, TN (US)

( * ) Notice: Subject to any disclaimer, the term of this patent is extended or adjusted under 35 U.S.C. 154(b) by 0 days.

(21) Appl. No.: 18/141,477

(22) Filed: May 1, 2023

(65) Prior Publication Data

US 2023/0382613 A1 Nov. 30, 2023

Related U.S. Application Data

(60) Provisional application No. 63/345,432, filed on May 25, 2022.

(51) Int. Cl.
*B65D 51/28* (2006.01)

(52) U.S. Cl.
CPC ..... *B65D 51/2828* (2013.01); *B65D 51/2885* (2013.01)

(58) Field of Classification Search
CPC ..... B65D 51/2828; B65D 83/049; B65D 51/2835; B65D 85/72; B65D 51/222; B65D 51/22
USPC ..... 206/222
See application file for complete search history.

(56) References Cited

U.S. PATENT DOCUMENTS

2017/0107045 A1* 4/2017 Brosse ..... B65D 83/0409
2018/0093803 A1* 4/2018 Love ..... B65D 51/2835
2023/0126929 A1* 4/2023 Joseph ..... B65D 83/049 206/222

* cited by examiner

*Primary Examiner* — Anthony D Stashick
*Assistant Examiner* — Raven Collins
(74) *Attorney, Agent, or Firm* — Dhiraj Jindal; PATENT YOGI LLC

(57) ABSTRACT

An apparatus for facilitating dispensing payloads into a container. The apparatus is couplable with an opening of the container and includes a placing element and a dispensing element. The placing element is coupled with the opening, includes first openings fluidly coupled with the opening, and defines payload receptacles around the first openings. The payload receptacles define recesses for receiving payload holders. The payload holders include breakable layers for releasably securing the payloads into the payload holders. The dispensing element is coupled with the placing element, transitions from a first position to a second position based on an external action, and includes a pressing element. The pressing element presses the payload holders based on the transitioning for breaking the breakable layers and releasing the payloads from the payload holders. The payloads pass through the first openings for dispensing the payloads into the container based on the releasing.

20 Claims, 22 Drawing Sheets

APPARATUS FOR FACILITATING DISPENSING PAYLOADS INTO A CONTAINER

CROSS-REFERENCE TO RELATED APPLICATION

This application claims the benefit of U.S. Provisional Patent Application No. 63/345,432, titled "AN APPARATUS FOR FACILITATING DISPENSING A TABLET INTO A CONTAINER", filed 25 May 2022, which is incorporated by reference herein in its entirety.

FIELD OF THE INVENTION

Generally, the present disclosure relates to a field of accessories for container closures. More specifically, the present disclosure relates to an apparatus for facilitating dispensing payloads into a container.

BACKGROUND OF THE INVENTION

The field of accessories for container closures is technologically important to several industries, business organizations, and/or individuals. In particular, the use of accessories for container closures is prevalent for apparatus for facilitating dispensing payloads into a container.

Hydrogen-infused water enhances or improves the athletic performance of individuals and reduces inflammation from exercise and introduces powerful antioxidants into the bodies of the individuals. Further, hydrogen tablets are dispensed in the water to make the hydrogen-infused water. Further, the hydrogen tablets are stored in blister packs because they are required to be stored in a low-moisture environment. Further, these hydrogen tablets are required to be handled without contaminating them while they are removed from their packaging and dispensed into the bottle.

Existing techniques for dispensing payloads (tablets) in a container are deficient with regard to several aspects. Furthermore, current apparatuses do not dispense payloads directly into containers in a hygienic way. As a result, different apparatuses are needed that dispense the payloads directly into the container without contaminating the payloads. Moreover, current apparatuses do not prevent pieces of the packaging of the tablet from falling into the container when the tablet is pushed into the container by tearing the bottom aluminum layer of the packaging open. As a result, different apparatuses are needed that prevent the pieces of the packaging of the tablet from falling into the container when the tablet is pushed into the container by tearing the bottom aluminum layer of the packaging open.

Therefore, there is a need for an apparatus for facilitating dispensing payloads into a container that may overcome one or more of the above-mentioned problems and/or limitations.

SUMMARY OF THE INVENTION

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

Disclosed herein is an apparatus for facilitating dispensing payloads into a container, in accordance with some embodiments. Accordingly, the apparatus may be couplable with an opening of the container. Further, the opening leads into an interior of the container. Further, the apparatus may include a placing element coupled with the opening of the container based on the coupling of the apparatus. Further, the placing element may include one or more first openings fluidly coupled with the opening based on the coupling of the placing element. Further, the placing element defines one or more payload receptacles on a top side of the placing element. Further, the one or more payload receptacles may be disposed around the one or more first openings. Further, the one or more payload receptacles define one or more recesses for receiving one or more payload holders comprising one or more payloads. Further, the one or more payload holders may include one or more breakable layers for releasably securing the one or more payloads into the one or more payload holders. Further, the one or more breakable layers oppose the one or more first openings based on the receiving. Further, the apparatus may include a dispensing element coupled with the placing element. Further, the dispensing element may be configured for transitioning from a first position to at least one second position in relation to the placing element based on at least one external action receivable by the dispensing element. Further, the dispensing element may include a pressing element disposed on a bottom side of the dispensing element. Further, the pressing element may be configured for pressing the one or more payload holders with at least one amount of force based on the transitioning. Further, the pressing of the one or more payload holders breaks the one or more breakable layers for releasing the one or more payloads from the one or more payload holders. Further, the one or more payloads pass through the one or more first openings for dispensing the one or more payloads into the interior of the container based on the releasing.

Further disclosed herein is an apparatus for facilitating dispensing payloads into a container, in accordance with some embodiments. Further, the apparatus may be couplable with an opening of the container. Further, the opening leads into an interior of the container. Further, the apparatus may include a placing element coupled with the opening of the container based on the coupling of the apparatus. Further, the placing element may include one or more first openings fluidly coupled with the opening based on the coupling of the placing element. Further, the placing element defines one or more payload receptacles on a top side of the placing element. Further, the one or more payload receptacles may be disposed around the one or more first openings. Further, the one or more payload receptacles define one or more recesses for receiving one or more payload holders may include one or more payloads. Further, the one or more payload holders may include one or more breakable layers for releasably securing the one or more payloads into the one or more payload holders. Further, the one or more breakable layers oppose the one or more first openings based on the receiving. Further, the placing element may be configurable for creating a seal between the placing element and a periphery of the opening using at least one seal creating element based on the coupling of the placing element. Further, the apparatus may include a dispensing element coupled with the placing element. Further, the dispensing element may be configured for transitioning from a first position to at least one second position in relation to the placing element based on at least one external action receivable by the dispensing element. Further, the dispensing element may include a pressing element disposed on a bottom side of the dispensing element. Further, the pressing element may be configured for pressing the one or more payload holders with at least one amount of force based on the transitioning. Further, the pressing of the one or more payload holders breaks the one or more breakable layers for releasing the one or more payloads from the one or more payload holders. Further, the one or more payloads pass through the one or more first openings for dispensing the one or more payloads into the interior of the container based on the releasing.

Further disclosed herein is an apparatus for facilitating dispensing payloads into a container, in accordance with some embodiments. Accordingly, the apparatus may include the container that may include an interior and an opening leading into the interior of the container. Further, the apparatus may include a placing element coupled with the opening of the container based on the coupling of the apparatus. Further, the placing element may include one or more first openings fluidly coupled with the opening based on the coupling of the placing element. Further, the placing element defines one or more payload receptacles on a top side of the placing element. Further, the one or more payload receptacles may be disposed around the one or more first openings. Further, the one or more payload receptacles define one or more recesses for receiving one or more payload holders comprising one or more payloads. Further, the one or more payload holders may include one or more breakable layers for releasably securing the one or more payloads into the one or more payload holders. Further, the one or more breakable layers oppose the one or more first openings based on the receiving. Further, the apparatus may include a dispensing element coupled with the placing element. Further, the dispensing element may be configured for transitioning from a first position to at least one second position in relation to the placing element based on at least one external action receivable by the dispensing element. Further, the dispensing element may include a pressing element disposed on a bottom side of the dispensing element. Further, the pressing element may be configured for pressing the one or more payload holders with at least one amount of force based on the transitioning. Further, the pressing of the one or more payload holders breaks the one or more breakable layers for releasing the one or more payloads from the one or more payload holders. Further, the one or more payloads pass through the one or more first openings for dispensing the one or more payloads into the interior of the container based on the releasing.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and subcombinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAIL DESCRIPTIONS OF THE INVENTION

Figure 1:
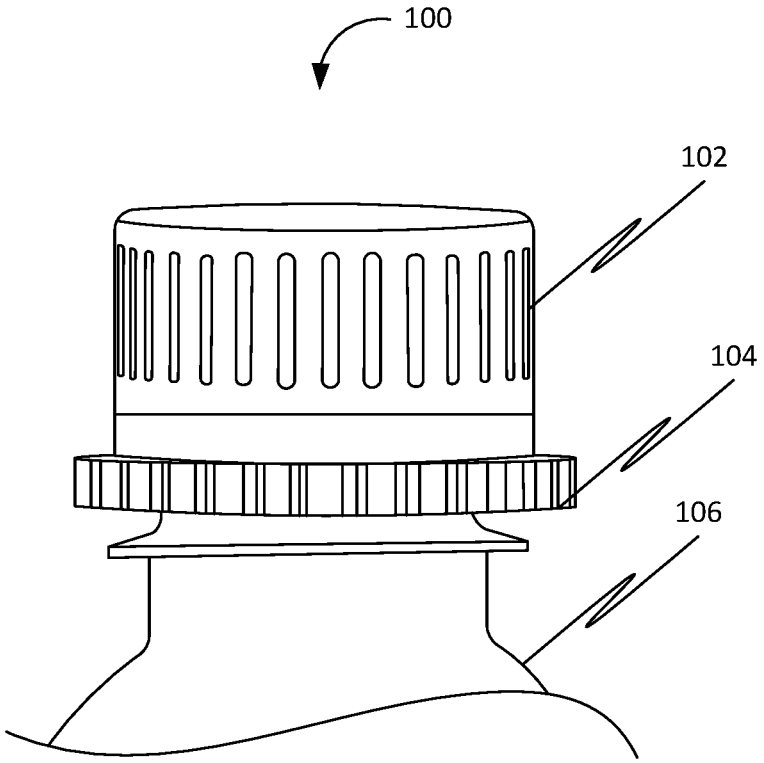
FIG. 1 is a front view of an apparatus 100 for facilitating dispensing payloads into a container 106, in accordance with some embodiments.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim limitation found herein and/or issuing here from that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the claims found herein and/or issuing here from. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of apparatus for facilitating dispensing payloads into a container, embodiments of the present disclosure are not limited to use only in this context.

Overview:

The present disclosure describes an apparatus for facilitating dispensing payloads into a container. Further, the apparatus may be used with medical-grade aluminum blister packs. Further, the positions and exterior dimensions of payloads may be customized. Further, the payloads may include but may not be limited to tablets, pills, and capsules that be made in a wide range of shapes and sizes and the blister pack mold may be made to accommodate about any size or shape of the payloads. Further, the apparatus may provide a 100% barrier against water vapor, gases, etc. Further, the apparatus may provide anti-oxygen, moisture-proof, and leak-proof conditions for the payloads. Furthermore, the apparatus may provide a high degree of thermal stability and sanitation to the payloads. Further, the payloads may be packed inside a tablet holder.

Further, the apparatus may dispense payloads packed inside a clear plastic blister pack. Further, the clear plastic may be more rigid than aluminum blister packs and may be harder to work with. The aluminum blister packs may perform better and may provide more flexibility and design options than the clear plastic blister packs. Further, pushing the tablet through the aluminum blister pack may tear open the bottom aluminum layer of the aluminum blister pack. Further, a piece of the bottom aluminum layer may fall into the bottle. However, the piece of the bottom aluminum layer may be prevented from falling into the bottle using several techniques such as scoring or coating the bottom layer, etc. Further, the apparatus may include a cap and a basket (or placing element). Further, in some embodiments, the basket clips into the cap and may turn and float up and down as designed. Further, the apparatus may include a wadding to provide a seal between the basket and the container (or bottle). Further, the container may include but may not be limited to a standard 16-ounce bottle with a 1-inch opening. Further, the container may include but may not be limited to a bottle with a larger mouth such as a Gatorade bottle. Further, the friction created by threads on the bottle may keep the basket stationary until the tablet may be pushed through the blister pack. However, the exterior dimensions will be slightly larger than a typical bottle cap. Further, the apparatus may include a wedge. Further, the cap and wedge may be clipped or sonic welded together. Further, in some embodiments, the wedge may be an integral part of the cap. Further, circular tabs may be used to lock the cap into the basket and to allow the cap to twist, pressing the payload out, without turning the basket until the circular tabs lock into their final position. Further, the basket screws on the bottle. Further, the blister pack may be placeable on top of the basket. Further, the basket may include a locking channel. Further, the locking channel may interface with the circular tabs on the cap. Further, the locking channel may secure the cap in its initial location once pressed on. Further, the locking channel may allow the cap to twist, pressing the table into the bottle, without turning the basket. Further, the locking channel may lock the cap to the basket once it is in its final position. Further, the cap may be rotated approximately 140° moving the wedge into the blister pack and pressing the tablet out and into the bottle below. Once in the final position, the cap may be locked into place allowing the basket and cap to be twisted off the bottle like a typical cap. Further, the tablet holder may be placed into the basket and then clipped into the cap. Further, the cap may include exterior dimensions identical to a typical cap and may be screwed on using a screwing mechanism that screws on a typical cap. Further, the basket may include a lip that may seal on top and bottom. Further, the top may be identical to an opening of a bottle and the bottom may be identical to a cap seal similar to an "o" ring seal. Further, the basket may fit tight enough to the opening to prevent turning. Further, the basket may not be impacted by turning the cap until a lip of the wedge catches the lip on the basket. Further, the wedge may be rotated to push the payloads out before catching and lifting the basket up with the rest of the cap. Further, the basket may be made out of a softer cap material to provide a better seal and stickiness. Further, the cap may be screwed on. Further, the basket may be disposed on the bottle with a slight interference fit between the basket and the bottle to provide friction to keep the basket in place. Further, in some embodiments, turning the cap to the first 180 degrees may not apply pressure on the basket. Further, as the cap turns and moves up, the cap turns the wedge that pushes the tablet down and out. Further, at the 180° point, the lip on the outside of the wedge may be raised up in a dead space to a point that the wedge catches the interior lip on the basket pulling the basket up and out of the bottle. Further, the cap may be screwed back on to reseal like a typical cap.

Further, in some embodiments, the cap may slide over the basket exterior. Further, the apparatus may include a base that clips into the basket to support the tablet holder. Further, the cap may clip into place using a tongue and groove system that may allow the cap to rotate about 180° before the cap starts to turn the basket when screwing it off. Further, a security ring may hold the cap in place during the cap may be tightened onto the bottle. Further, the basket may be threaded internally to help the basket to screw onto the bottle. Further, the tablet holder and the base may be clipped into the basket. Further, the lip of the base sits on the bottle opening with the tablet holder on top of it. Further, the basket presses down on both when tightened. Further, the cap may be turned 180° to open. Further, the wedge pushed the tablet down and out. Further, the cap engages the basket and screws it off.

The present disclosure describes an apparatus for facilitating dispensing a tablet into a container. Further, the disclosed apparatus may include a container cap (or cap) for containers such as bottles that utilize a removable cap. Further, the cap may retain a pill or other suitable payload separate from the contents of the container until the user twists the cap to dispense the payload into the container below. Further, the payload can be pills, capsules, tablets, vitamins, medicines, flavor pills, dye pills, or any other solid material that is desired to be deposited into a beverage contained below the cap. Further, the cap may be especially useful for single-use and disposable bottles.

Figure 3:
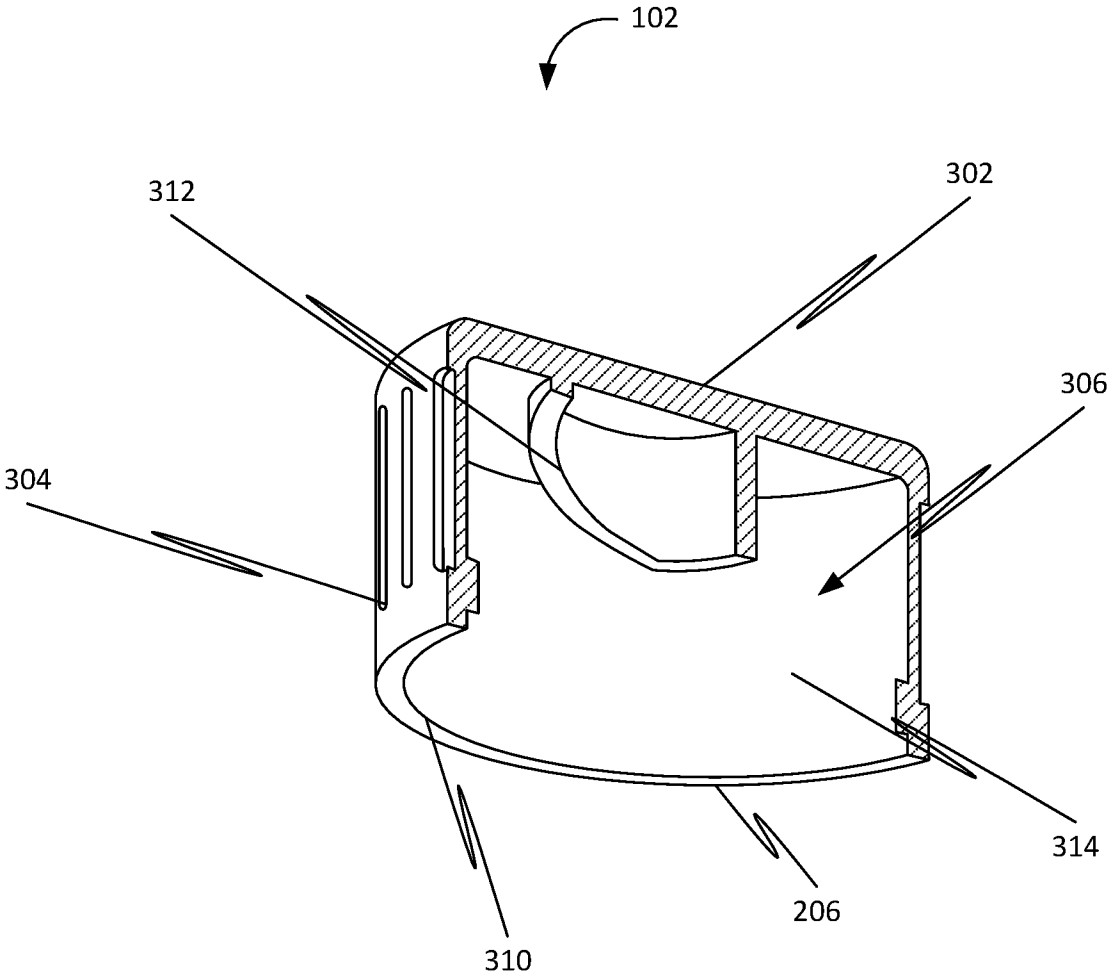
FIG. 3 is a bottom perspective cross-sectional view of the dispensing element 102 of the apparatus 100, in accordance with some embodiments.
Figure 5:
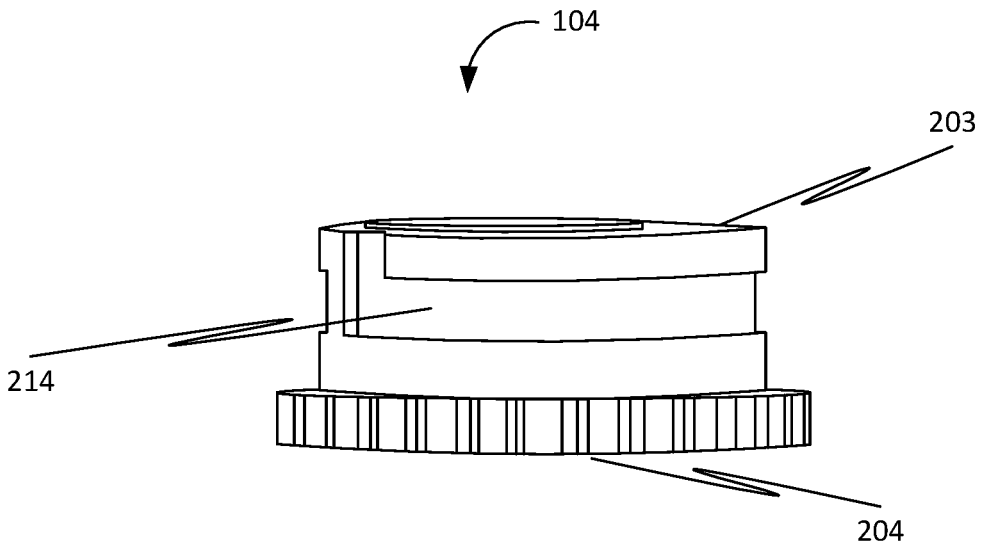
FIG. 5 is a front view of the placing element 104 of the apparatus 100, in accordance with some embodiments.

The present disclosure describes an apparatus for facilitating dispensing a tablet into a container. Further, the disposable apparatus may include a tablet dispensing bottle cap. Further, the disposable apparatus may use medical-grade aluminum blister packs. Further, the tablet position and exterior dimension of the blister packs may be customized. Further, at least one payload (such as a tablet, pill, capsule, etc.) may be made in a wide range of shapes and sizes and the blister pack mold (or the blister pack) may be made to accommodate about any size or shape of the at least one payload. This may allow for optimizations far beyond working with off-the-shelf blister packs. Further, the blister pack may provide a 100% barrier against water vapor, gases, etc. Further, the blister packs may be anti-oxygen, moisture-proof, and leak-proof. Further, the blister packs may provide a high degree of thermal stability and sanitation. Further, the disposable apparatus may use an off the self-clear plastic blister pack (payload package). Further, clear plastic may be more rigid than the aluminum blister. Further, the disposable apparatus may be associated with custom aluminum blister packs (payload package) that may perform better and may provide more flexibility and design options than the traditional packs. Further, the disposable apparatus may include a cap and a basket. Further, the disposable apparatus may include a wadding configured to provide a seal between the basket and the bottle. Further, the disposable apparatus may include a wedge (as shown in FIG. 3) built into the cap. Further, the cap may include circular tabs that may be used to lock the cap into the basket and to allow the cap to twist, pressing the tablet out of the blister pack, without turning the basket until the circular tabs lock into their final position. Further, the basket may screw on the bottle. Further, the blister pack may be located on top of the basket. Further, in some embodiments, the cap may accommodate a plurality of blister packs (such as the blister pack). Further, the plurality of blister packs may be located on the top of the basket. Further, the basket may include a locking channel (as shown in FIG. 5). Further, the locking channel may interface with the circular tab on the cap. The locking channel may be configured to facilitate securing the cap in its initial location once pressed on. Further, the locking channel may allow the cap to twist, pressing the table into the bottle, without turning the basket. Further, the locking channel may facilitate locking the cap to the basket once it is in its final position.

Figure 11:
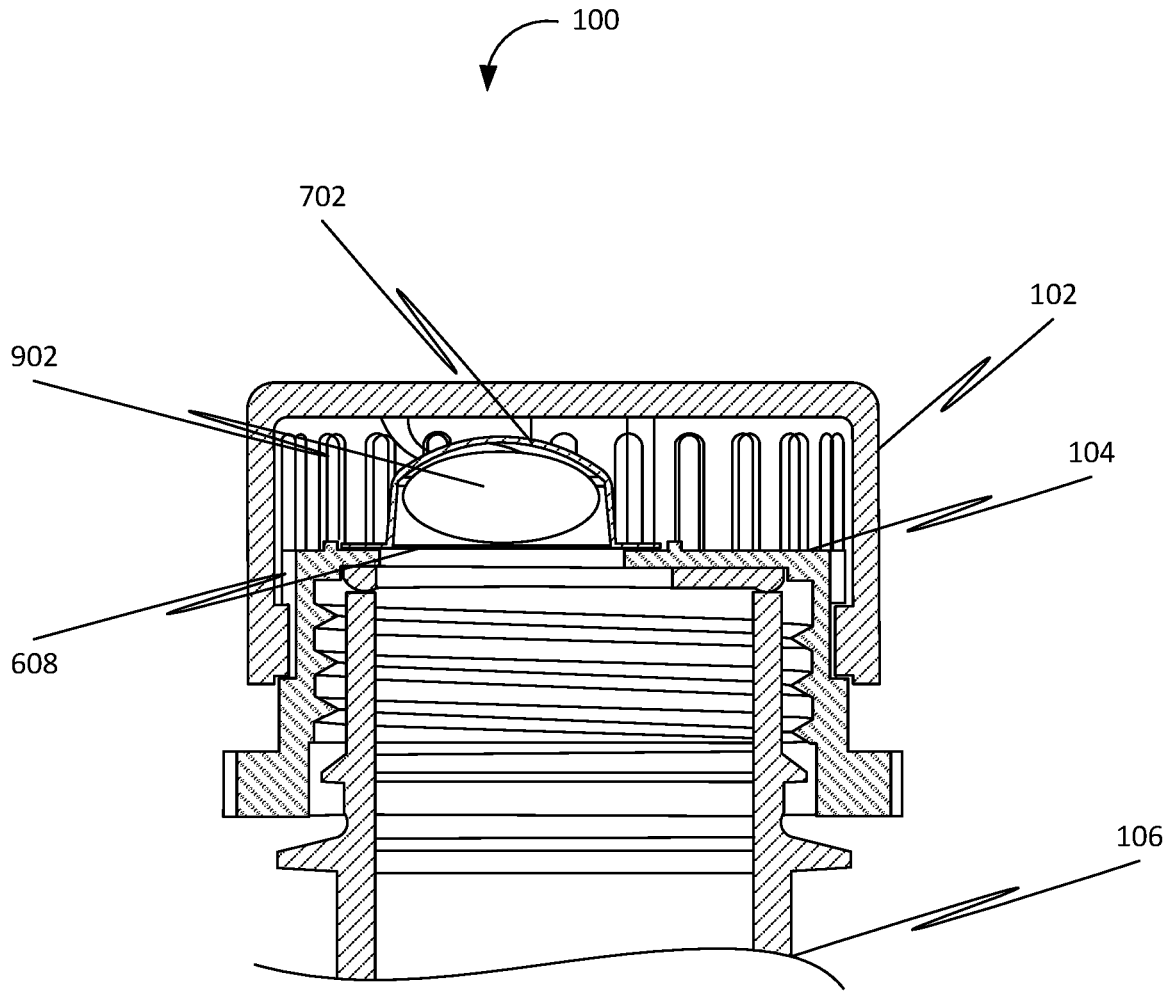
FIG. 11 is a cross-sectional view of the apparatus 100, in accordance with some embodiments
Figure 12:
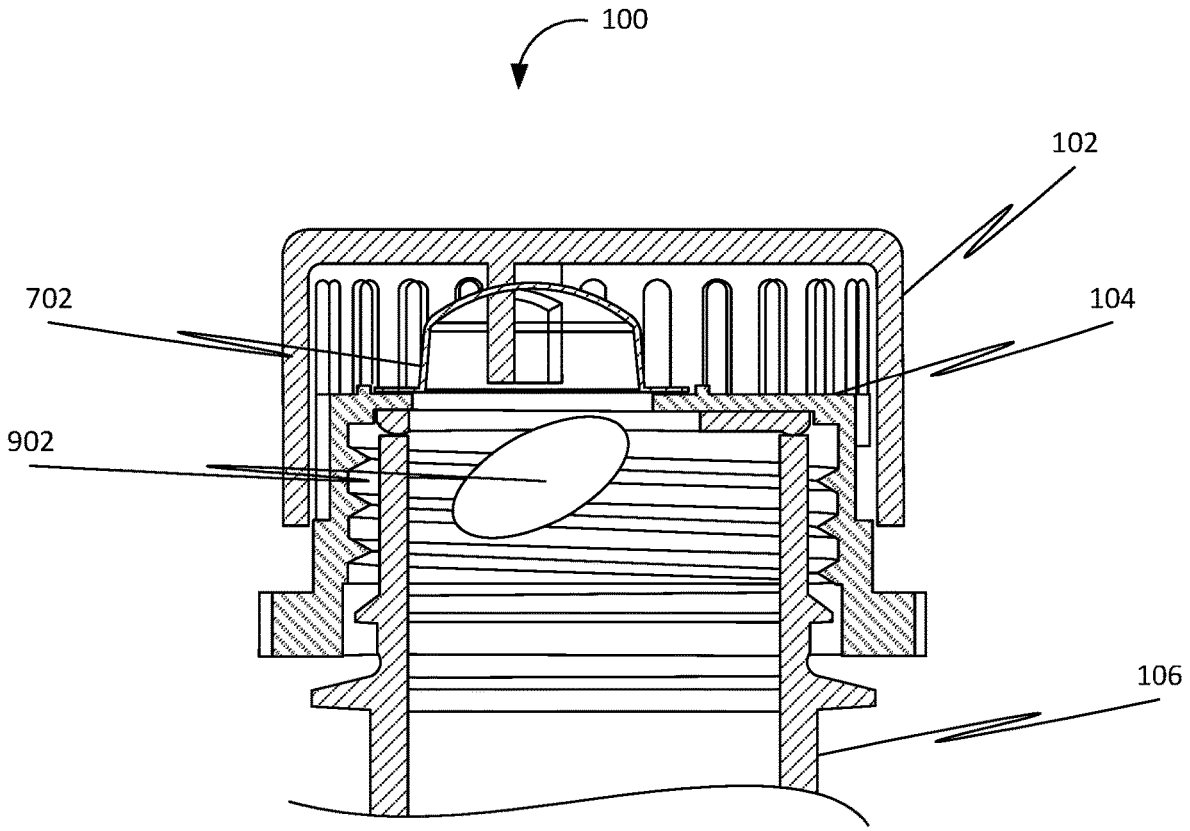
FIG. 12 is a cross-sectional view of the apparatus 100, in accordance with some embodiments.

Further, the cap may be rotated approximately 140° moving the wedge into the blister pack and pressing the tablet out and into the bottle below. Once in the final position, the cap may be locked into place allowing the basket and cap to be twisted off the bottle like a typical cap. Further, as shown in FIG. 11, in the initial position, the tablet may be in a storage position. Further, as shown in FIG. 12, in the final position, the tablet may be dispensed into the bottle. Further, in some embodiments, the disposable apparatus may be configured for dispensing the tablet comprising a hydrogen tablet for allowing an individual to drink hydrogen water. Further, the hydrogen water may be normal water that has extra hydrogen gas added to it. The added hydrogen may be tasteless and odorless. Further, the hydrogen water (or hydrogen gas-infused water) may improve athletic performance and reduce inflammation from exercise, and delivers powerful antioxidants. Further, antioxidants have immense health benefits. All these factors are increasing the demand for hydrogen water across the world. Further, the hydrogen water may provide improved endurance. Further, the hydrogen water works as a signal modulator, reduces lactic acid, increases metabolism, and supports weight loss. It also allows the individual to work out longer, more often, with less fatigue and stiffness. Further, the hydrogen water may provide increased energy. Further, the hydrogen water signals cells in a person's body to produce more natural energy (ATP) and protects the cells from oxidative stress, which can damage cells and lower energy levels. Furthermore, the hydrogen water may provide regenerative benefits by neutralizing harmful free radicals and oxidative stress, which is the leading cause of disease. Further, the hydrogen water has been proven to help regulate heart disease, and diabetes, reduce wrinkles and skin issues, and speed up wound healing. Further, the hydrogen water may support cognitive function. As a selective antioxidant, the hydrogen water has been proven to improve mental clarity, prevent cognitive illness, reduce oxidative stress and inflammation, boost mental focus and clarity, and help with mental illnesses. Further, the disposable apparatus may facilitate providing the hydrogen water product in a plastic bottle. Further, the hydrogen tablet may provide up to 12 ppm of hydrogen when dissolved in water. Further, the disposable apparatus when attached to the plastic bottle may securely dispense the hydrogen tablet in the water in the bottle allowing the user to see the making of the hydrogen in the bottle. When the cap is twisted, it activates and drops the hydrogen tablet into the bottle. As soon as the tablet hits the water it starts to infuse hydrogen into the water.

Figure 7:
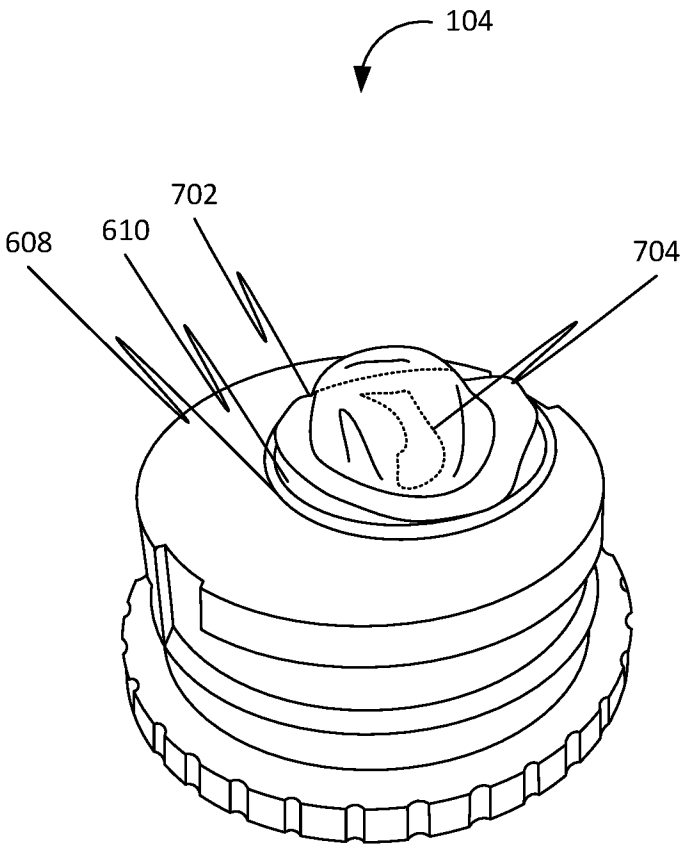
FIG. 7 is a top perspective view of the placing element 104 of the apparatus 100 with the one or more payload holders 702, in accordance with some embodiments.

Further, in an instance, an off-the-shelf blister pack and tablet may be loaded/secured into the basket, using a food-safe adhesive. Further, the cap may be locked into place and then installed onto a bottle. The cap may be twisted causing the tablet to be successfully pressed out and into the bottle. FIG. 7 shows the basket and blister pack and the result of the tablet being pushed out of the blister pack into a bottle. Further, in some embodiments, the basket may include a receptacle. Further, the tablet may be sealed in the receptacle during the production process. Further, the receptacle may be made up of rubber around the tablet to provide the same effect as the blister pack. Further, the receptacle may be a part of the basket and not a separate part.

Further, the apparatus may include a cap, a wedge, and a basket. Further, in an embodiment, the cap and wedge may be clipped or sonic welded together. Further, the cap and the wedge may be one part. The basket may clip into the cap and may turn and float up and down as designed. Further, the reusable apparatus may include a security ring. Further, the reusable apparatus may include a tablet holder that may be placed into the basket and then clipped into the cap. Further, the tablet holder may be configured for accommodating the at least one payload. Further, in some embodiments, the tablet holder may be configured for accommodating a plurality of payloads (such as the at least one payload). Further, the cap may have the same exterior dimensions as a typical bottle cap and can be screwed on using the same machine that screws on the typical bottle cap. Further, the reusable apparatus may be depicted is for a standard 16-ounce bottle with a 1-inch (dia) opening (approx.). However, the reusable apparatus may also work on a bottle with a larger mouth such as a Gatorade bottle. Further, the basket may be made out of a softer cap material to provide a better seal and to make it more "sticky". Further, when the cap may be screwed on, there is a slight interference fit between the basket and the bottle. This provides the friction to keep it in place. As the cap may be turned the first 180°, the cap may not apply pressure on the basket. Further, as the cap moves up, the cap turns the wedge which pushes the tablet down and out. At the 180° point, the lip on the outside of the wedge has raised up (in the dead space) to the point that it catches the interior lip on the basket pulling it up and out of the bottle. The cap may be screwed back on to reseal like the typical bottle cap. Further, the lip of the basket may seal on the top and bottom. Further, the top may mimic the bottle opening and the bottom may mimic the cap seal. Further, it may be similar to an O-ring seal. Further, the seal and interference fit may be tight enough to prevent turning. Further, the basket may not be impacted by the cap turning until the lip of the wedge catches the lip of the bottle. Further, the reusable apparatus may include a dead space allowing the wedge to be rotated pushing the tablet (or pill) out before catching and lifting the basket up with the rest of the cap.

Further, the apparatus may work better for smaller mouth bottles and relies on the friction created by the threads on the bottle to keep a basket stationary until the tablet is pushed through the blister pack. However, the exterior dimensions may be slightly larger than a typical bottle cap. Further, the apparatus may include a cap and a wedge clip that may be sonic welded together. Further, the apparatus may include a base that clips into the basket to support the tablet holder. The cap slides over the basket exterior and may clip into place using a tongue and groove system that will allow the cap to rotate about 180° before it starts to turn the basket when screwing it off. The apparatus may include a security ring that may hold the cap in place when it is tightened onto the bottle. Further, the interior of the basket may be threaded and screwed onto the bottle. Further, the tablet holder and the base may be clipped into the basket. Further, a lip of the base sits on the bottle opening with the tablet holder on top of it. The basket may press down on both when tightened. Further, when the cap may be turned 180° (to open) the wedge pushed the tablet down and out. Then the cap may engage the basket and screw it off.

Further, in some embodiments, the tablet holder may be configured for accommodating a plurality of payloads (such as the at least one payload).

Figure 2:
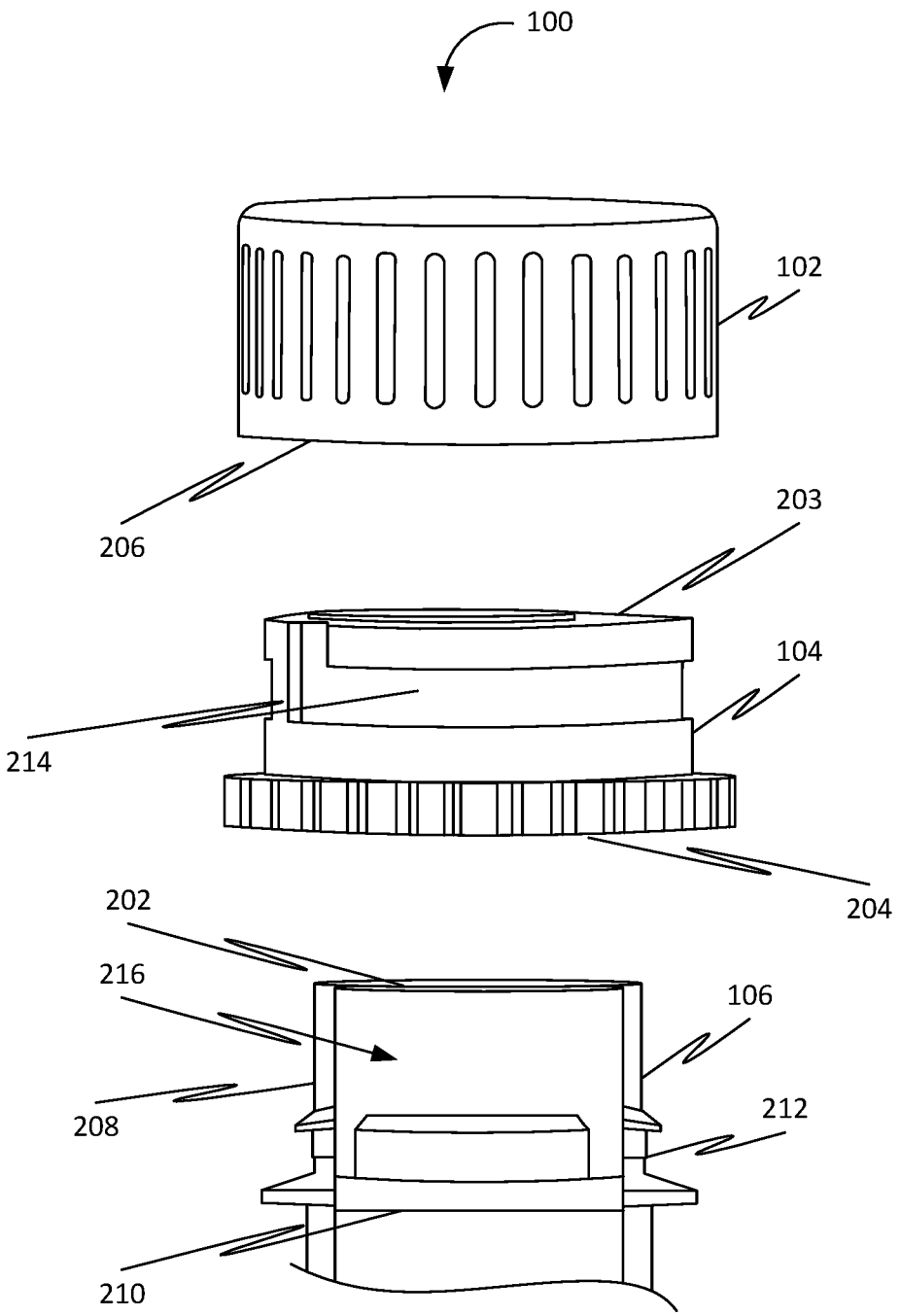
FIG. 2 is an exploded view of the apparatus 100, in accordance with some embodiments.
Figure 6:
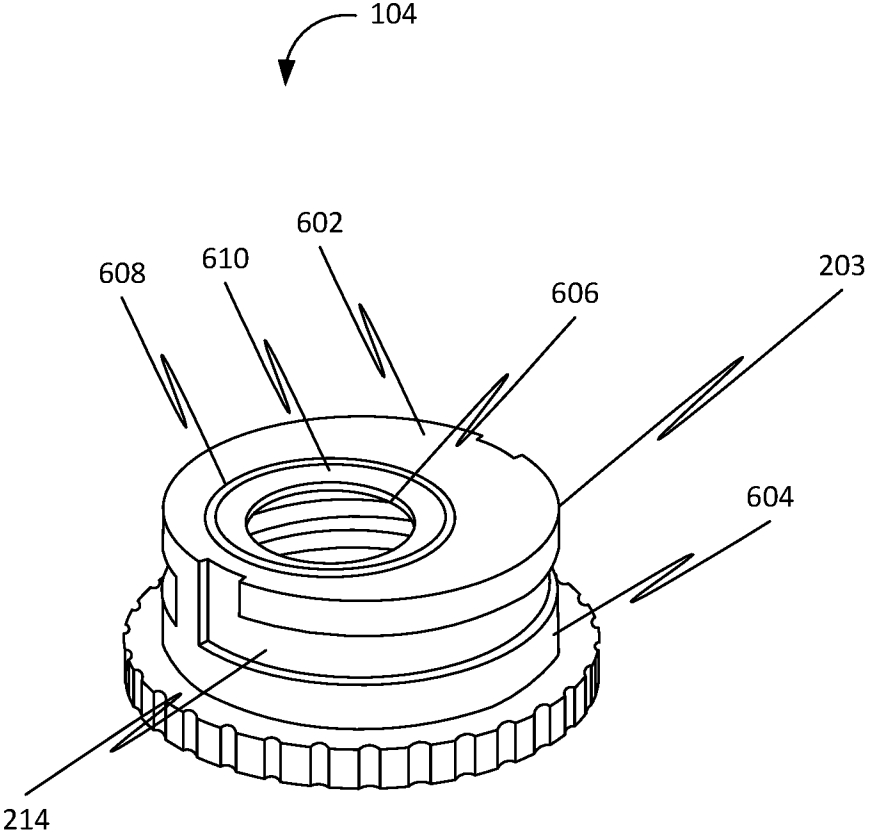
FIG. 6 is a top perspective view of the placing element 104 of the apparatus 100, in accordance with some embodiments.
Figure 9:
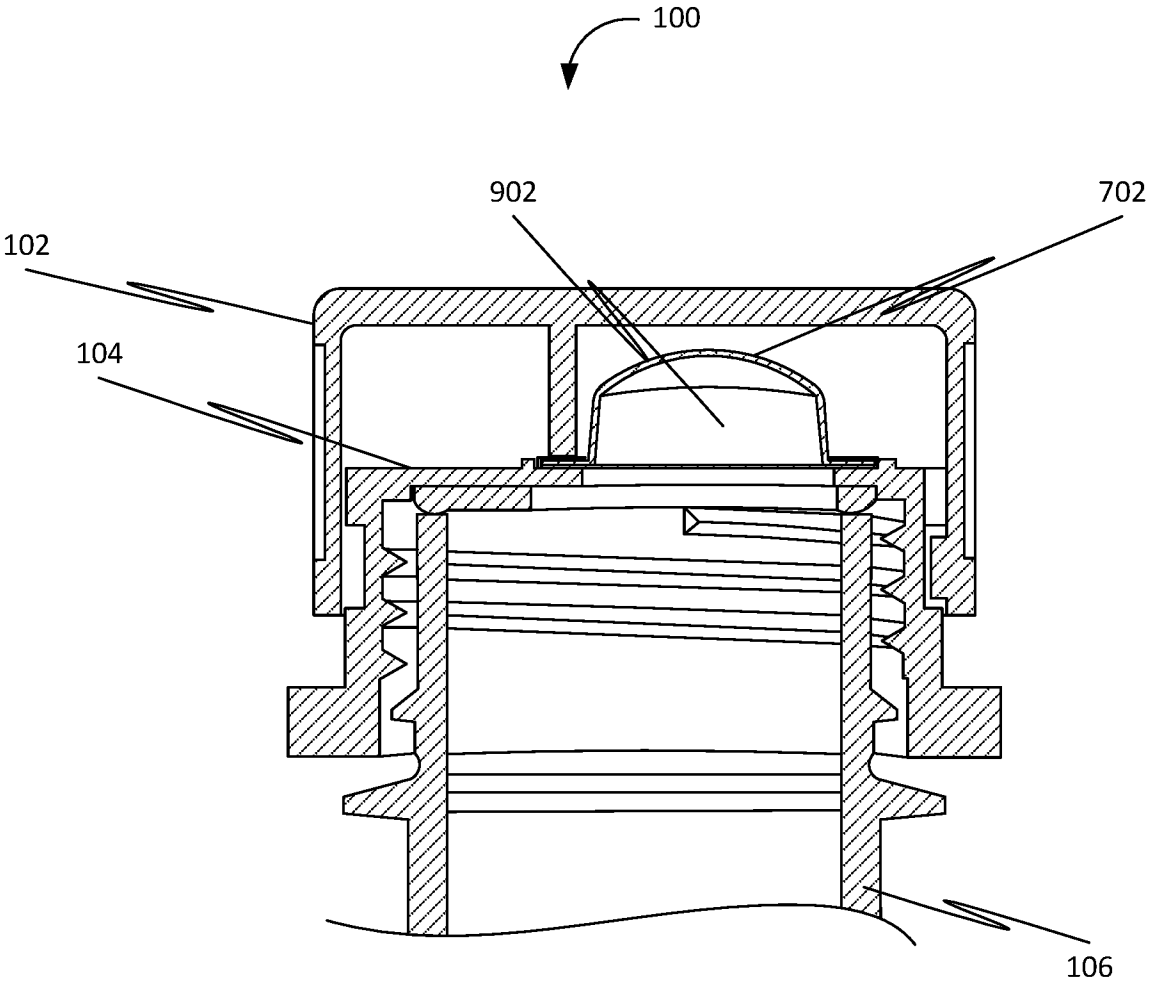
FIG. 9 is a cross-sectional view of the apparatus 100, in accordance with some embodiments.

FIG. 1 is a front view of an apparatus 100 for facilitating dispensing payloads into a container 106, in accordance with some embodiments. Further, the apparatus 100 may be couplable with an opening 202, as shown in FIG. 2, of the container 106. Further, in some embodiments, the apparatus 100 may be removably couplable with the opening 202 of the container 106. Further, the container 106 may include a bottle, a jar, etc. Further, the apparatus 100 may be a bottle cap, a jar lid, etc. Further, the opening 202 of the container 106 leads into an interior 216, as shown in FIG. 2, of the container 106. Further, the apparatus 100 may include a placing element 104 coupled with the opening 202 of the container 106 based on the coupling of the apparatus 100. Further, in some embodiments, the placing element 104 may be removably coupled with the opening 202 of the container 106. Further, the placing element 104 may be a basket. Further, the placing element 104 may include one or more first openings 606, as shown in FIG. 6, fluidly coupled with the opening 202 based on the coupling of the placing element 104. Further, the one or more first openings 606 may coincide with the opening 202 of the container 106 based on the coupling. Further, in some embodiments, the placing element 104 may be removably coupled with the opening 202 of the container 106. Further, the placing element 104 defines one or more payload receptacles 608, as shown in FIG. 6, on a top side 203, as shown in FIG. 2, of the placing element 104. Further, the one or more payload receptacles 608 may be a blister-pack locator. Further, the one or more payload receptacles 608 may be disposed around the one or more first openings 606. Further, the one or more payload receptacles 608 define one or more recesses 610, as shown in FIG. 6, for receiving one or more payload holders 702, as shown in FIG. 7, that may include one or more payloads 902, as shown in FIG. 9. Further, the one or more payload holders may be a blister pack, a tablet holder, a package, etc. Further, the one or more payloads 902 may include a tablet, a pill, a capsule, etc. Further, the one or more payload holders 702 may include one or more breakable layers 704, as shown in FIG. 7, for releasably securing the one or more payloads 902 into the one or more payload holders 702. Further, the one or more breakable layers 704 oppose the one or more first openings 606 based on the receiving.

Further, the apparatus 100 may include a dispensing element 102 coupled with the placing element 104. Further, in some embodiments, the dispensing element 102 may be removably coupled with the placing element 104. Further, the dispensing element 102 may be a cap. Further, the dispensing element 102 may be configured for transitioning from a first position to at least one second position in relation to the placing element 104 based on at least one external action receivable by the dispensing element 102. Further, the at least one external action may include a twisting action in at least one of a clockwise direction and a counterclockwise direction up to at least one degree of rotation. Further, the dispensing element 102 may include a pressing element 312, as shown in FIG. 3, disposed on a bottom side 206, as shown in FIG. 2, of the dispensing element 102. Further, the pressing element 312 may be a wedge. Further, the pressing element 312 may be configured for pressing the one or more payload holders 702 with at least one amount of force based on the transitioning. Further, the at least one amount of force corresponds to the at least one second position. Further, the pressing of the one or more payload holders 702 breaks the one or more breakable layers 704 for releasing the one or more payloads 902 from the one or more payload holders 702. Further, the one or more payloads 902 pass through the one or more first openings 606 for dispensing the one or more payloads 902 into the interior 216 of the container 106 based on the releasing.

Figure 8:
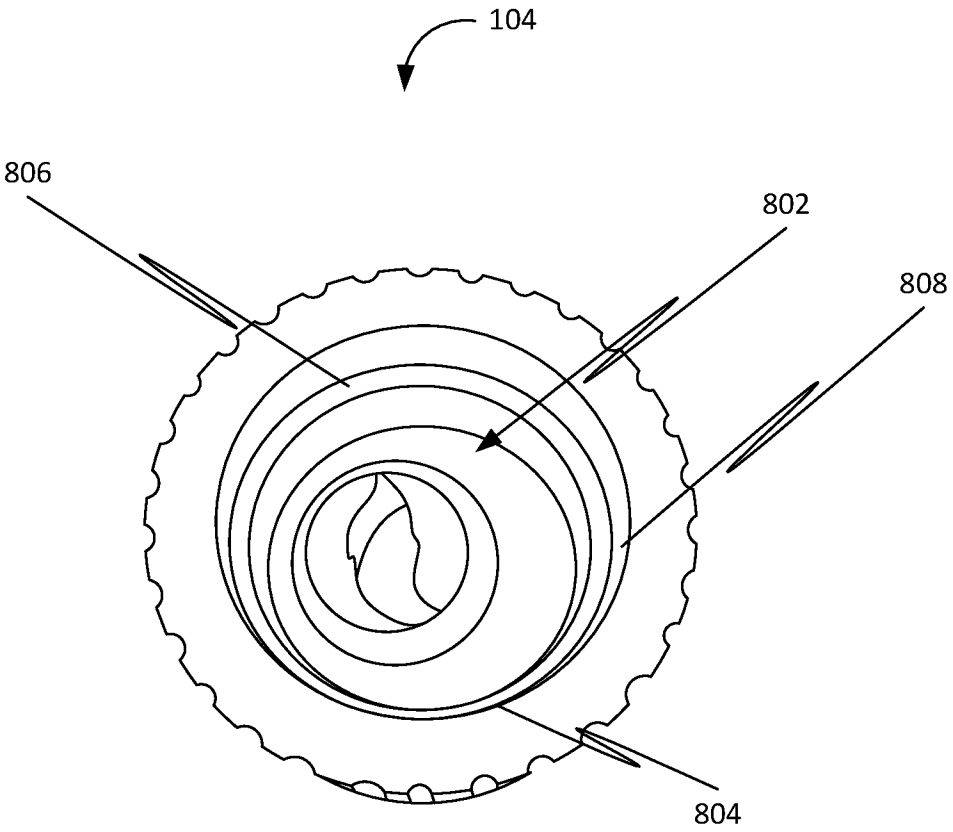
FIG. 8 is a bottom view of the placing element 104 of the apparatus 100, in accordance with some embodiments.

Further, in some embodiments, the placing element 104 may include a top wall 602, as shown in FIG. 6, and a side wall 604, as shown in FIG. 6, peripherally disposed around the top wall 602 defining an interior space 802, as shown in FIG. 8, and an opening 804, as shown in FIG. 8, on a bottom side 204, as shown in FIG. 2, of the placing element 104. Further, the placing element 104 may be configured for receiving at least a portion of a container portion 210, as shown in FIG. 2, of the container 106 in the interior space 802 of the placing element 104 through the opening 804 of the placing element 104 based on the coupling of the placing element 104. Further, the container portion 210 defines the opening 202 of the container 106.

Further in some embodiments, the placing element 104 may include at least one protrusion 806, as shown in FIG. 8, disposed on an inner surface 808, as shown in FIG. 8, of the side wall 604. Further, the at least one protrusion 806 may include at least one thread. Further, the at least one protrusion 806 may be configured for engaging with at least one channel 212, as shown in FIG. 2, disposed on an outer surface 208, as shown in FIG. 2, of the container portion 210. Further, the engaging may include threadedly engaging. Further, the coupling of the placing element 104 may be based on the engaging.

Further, in some embodiments, the dispensing element 102 may include a top wall 302, as shown in FIG. 3, and a side wall 304, as shown in FIG. 3, peripherally disposed around the top wall 302 defining an interior space 306, as shown in FIG. 3, and an opening 310, as shown in FIG. 3, in the bottom side 206 of the dispensing element 102. Further, the dispensing element 102 receives at least a part of the placing element 104 in the interior space 306 of the dispensing element 102 through the opening 310 of the dispensing element 102 based on the coupling of the dispensing element 102 with the placing element 104.

Further, in some embodiments, the dispensing element 102 may include a protrusion 308, as shown in FIG. 3, disposed on an inner surface 314 of the side wall 304 of the dispensing element 102. Further, the protrusion 308 may include a circular tab. Further, the protrusion 308 of the dispensing element 102 movably engages with a channel 214 (locking channel), as shown in FIG. 2, comprised in an outer surface of the side wall 604 of the placing element 104. Further, the coupling of the dispensing element 102 with the placing element 104 may be based on the movably engaging of the protrusion 308 of the dispensing element 102 with the channel 214 of the placing element 104.

Further in some embodiments, the coupling of the dispensing element 102 with the placing element 104 positions the protrusion 308 in an initial position in the channel 214 of the placing element 104. Further, the transitioning of the dispensing element 102 from the first position to the at least one second position may be based on the positioning of the protrusion 308 in the initial position.

Further, in some embodiments, the transitioning of the dispensing element 102 from the first position to the at least one second position may include moving the protrusion 308 from the initial position in the channel 214 of the placing element 104 to at least one final position in the channel 214 of the placing element 104. Further, the pressing of the one or more payload holders 702 with the at least one amount of force may be based on the moving of the protrusion 308 from the initial position in the channel 214 of the placing element 104 to the at least one final position in the channel 214 of the placing element 104.

Further, in some embodiments, the placing element 104 may be configured to be removably coupled with the opening 202 of the container 106 for transitioning between a closed state and at least one open state for openably closing the opening 202 of the container 106.

Further, in some embodiments, the dispensing element 102 may be configured to be disengagedly engaged with the placing element 104 for transitioning between an engaged state and a disengaged state. Further, the dispensing element 102 may be locked to the placing element 104 in the engaged state and the dispensing element 102 may be unlocked from the placing element 104 in the disengaged state. Further, the dispensing element 102 may be configured for transitioning between a first state and at least one second state based on at least one first action receivable by the dispensing element 102. Further, the transitioning of the dispensing element 102 corresponds to the transitioning of the placing element 104 in the engaged state. Further, the transitioning of the dispensing element 102 does not correspond to the transitioning of the placing element 104 in the disengaged state. Further, the at least one first action may include a twisting action in at least one of a clockwise direction and a counterclockwise direction up to at least one degree of rotation.

Further, in some embodiments, the dispensing element 102 may be removably coupled with the placing element 104 for transitioning between a closed state and at least one open state for openably closing the one or more payload receptacles 608. Further, the one or more payload receptacles 608 may be accessible for the receiving of the one or more payload holders 702 in the at least one open state. Further, the one or more payload receptacles 608 may be not accessible for the receiving of the one or more payload holders 702 in the closed state.

Figure 17:
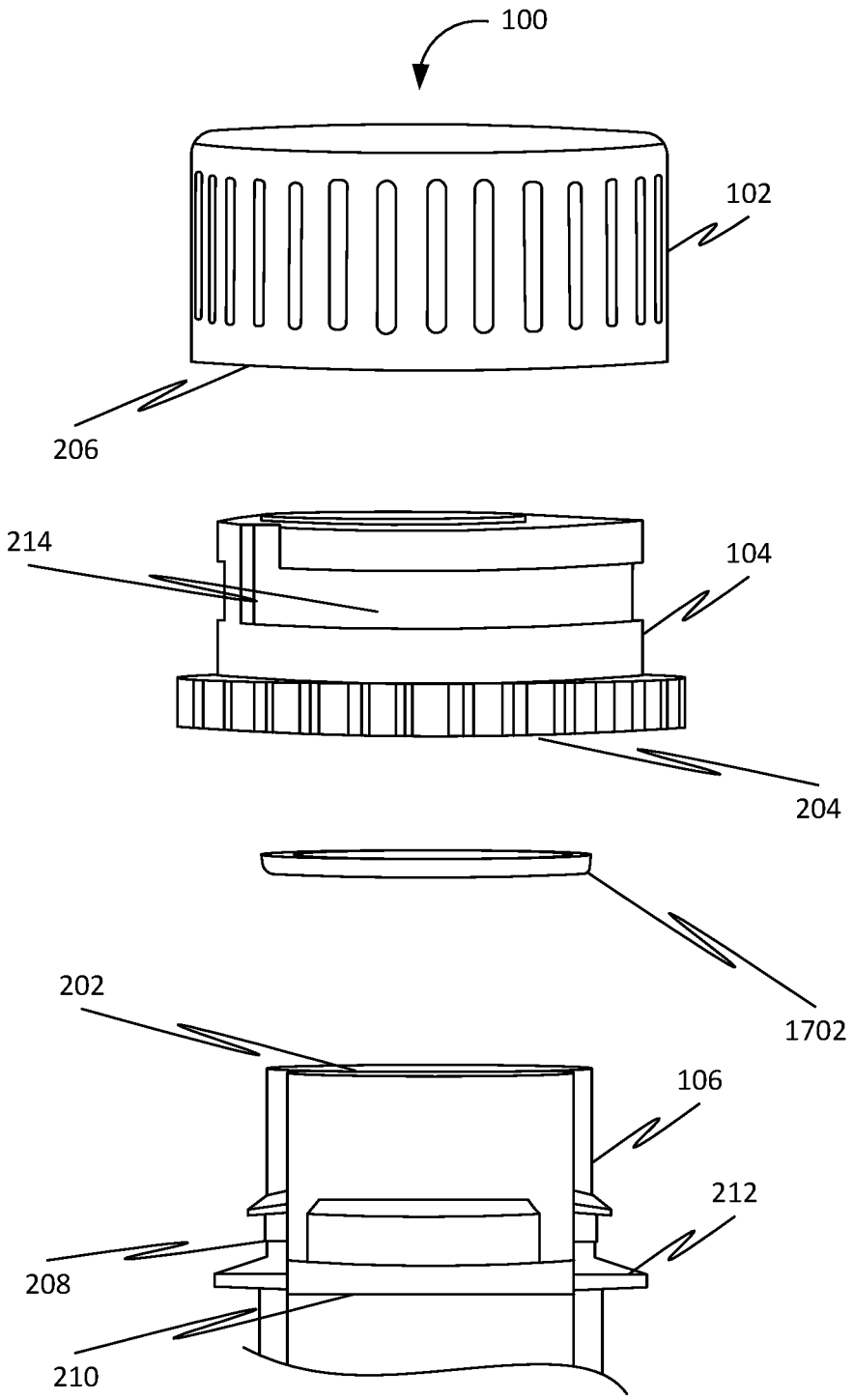
FIG. 17 is an exploded view of the apparatus 100, in accordance with some embodiments.

Further, in some embodiments, the placing element 104 may be configurable for creating a seal between the placing element 104 and a periphery of the opening 202 using at least one seal creating element 1702, as shown in FIG. 17, based on the coupling of the placing element 104. Further, in an instance, the at least one seal creating element 1702 may include a wadding Further, in some embodiments, the wadding disposable on the bottom side 204 of the placing element 104. Further, the wadding may be configured for creating the seal between the placing element 104 and a periphery of the opening 202 based on the coupling of the placing element 104. Further, the seal may be an airtight seal, a water-tight seal, etc.

FIG. 2 is an exploded view of the apparatus 100, in accordance with some embodiments.

FIG. 3 is a bottom perspective cross-sectional view of the dispensing element 102 of the apparatus 100, in accordance with some embodiments.

Figure 4:
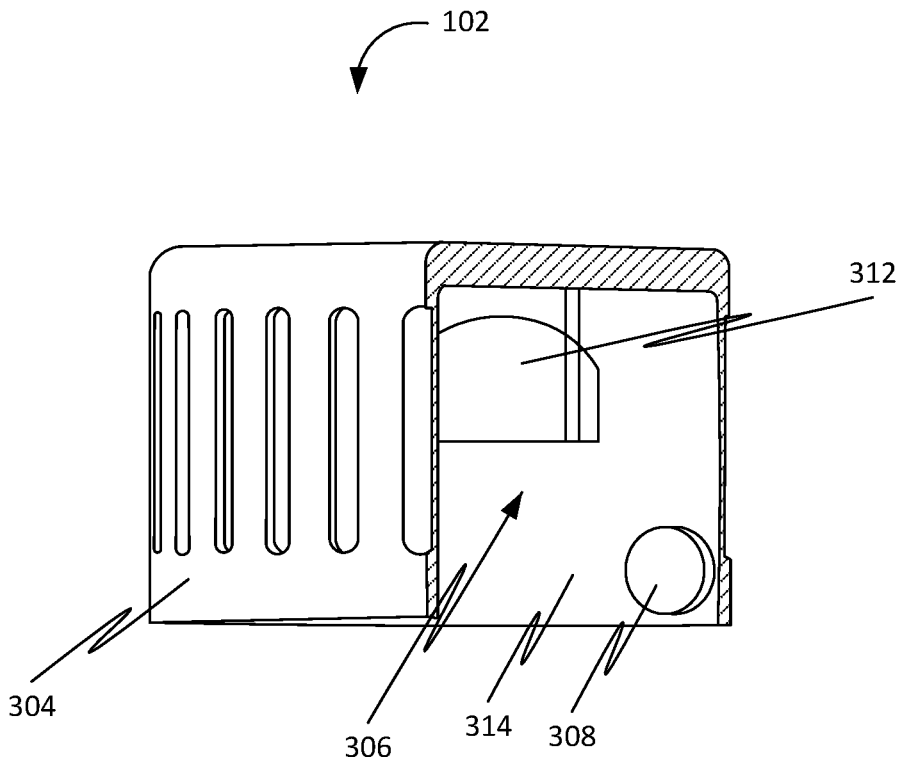
FIG. 4 is a front cross-sectional view of the dispensing element 102 of the apparatus 100, in accordance with some embodiments.

FIG. 4 is a front cross-sectional view of the dispensing element 102 of the apparatus 100, in accordance with some embodiments.

FIG. 5 is a front view of the placing element 104 of the apparatus 100, in accordance with some embodiments.

FIG. 6 is a top perspective view of the placing element 104 of the apparatus 100, in accordance with some embodiments.

FIG. 7 is a top perspective view of the placing element 104 of the apparatus 100 with the one or more payload holders 702, in accordance with some embodiments.

FIG. 8 is a bottom view of the placing element 104 of the apparatus 100, in accordance with some embodiments.

FIG. 9 is a cross-sectional view of the apparatus 100, in accordance with some embodiments.

Figure 10:
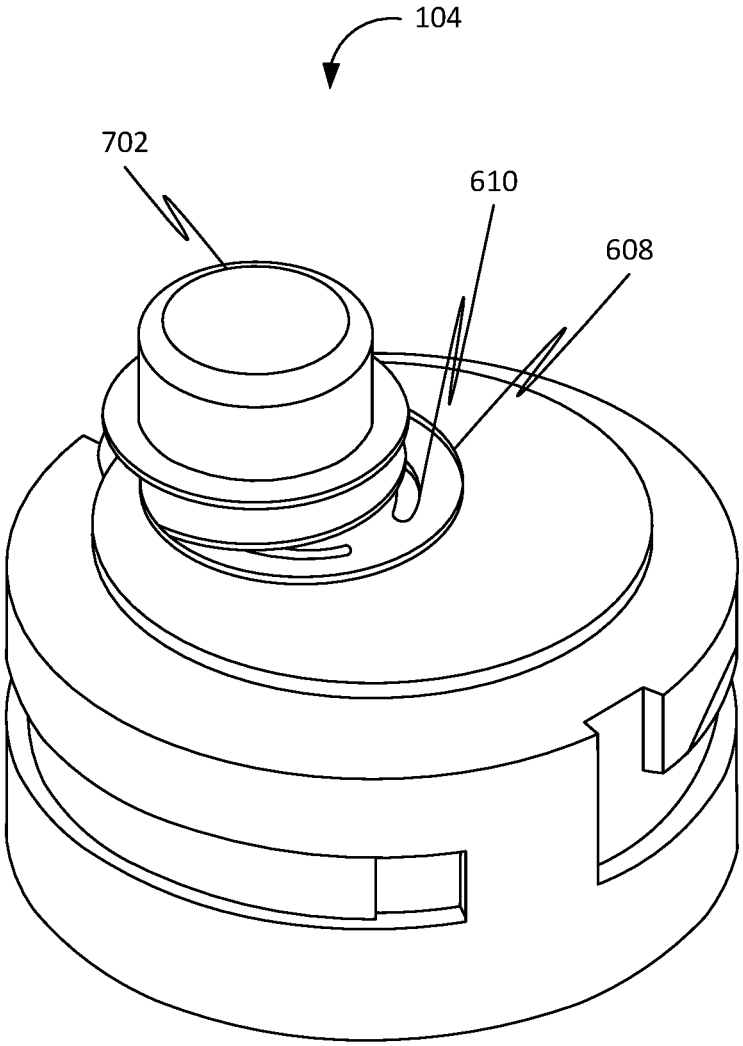
FIG. 10 is a top perspective view of the placing element 104 of the apparatus 100 with the one or more payload holders 702, in accordance with some embodiments.

FIG. 10 is a top perspective view of the placing element 104 of the apparatus 100 with the one or more payload holders 702, in accordance with some embodiments.

FIG. 11 is a cross-sectional view of the apparatus 100, in accordance with some embodiments. Further, the one or more payloads 902 may be removably packed inside the one or more payload holders 702. Further, the one or more payload holders 702 may be received by the one or more payload receptacles 608 of the placing element 104.

FIG. 12 is a cross-sectional view of the apparatus 100, in accordance with some embodiments. Further, the one or more payloads 902 may be dispensed in the interior 216 of the container 106.

Figure 13:
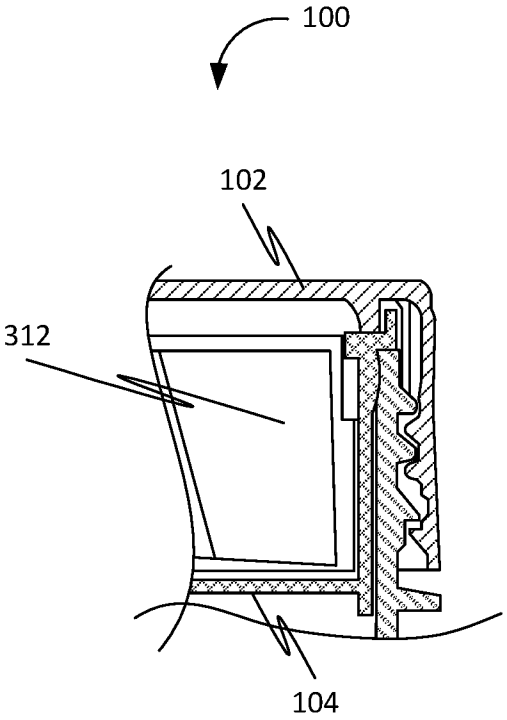
FIG. 13 is a partial cross-sectional view of the apparatus 100, in accordance with some embodiments.

FIG. 13 is a partial cross-sectional view of the apparatus 100, in accordance with some embodiments.

Figure 14:
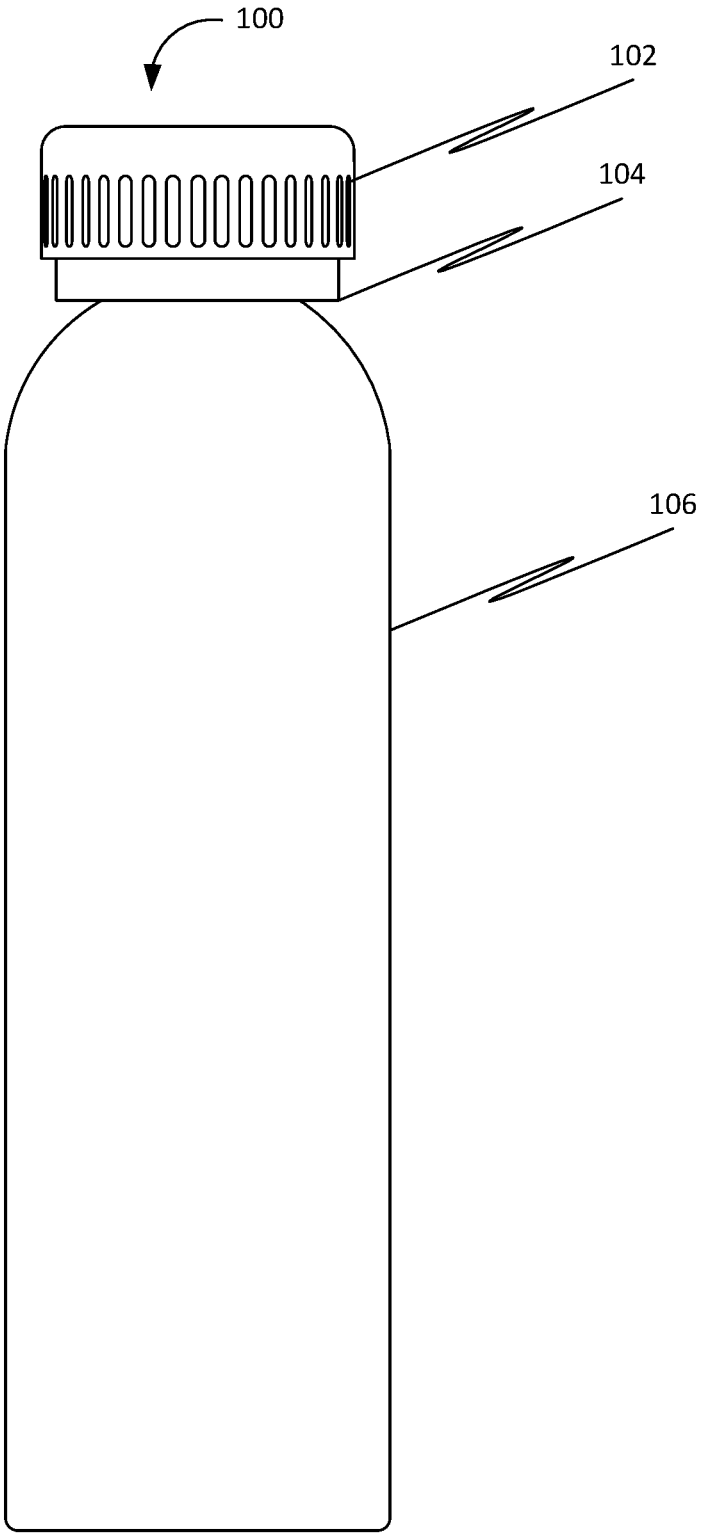
FIG. 14 is a front view of the apparatus 100 coupled with the container 106, in accordance with some embodiments.

FIG. 14 is a front view of the apparatus 100 coupled with the container 106, in accordance with some embodiments.

Figure 15:
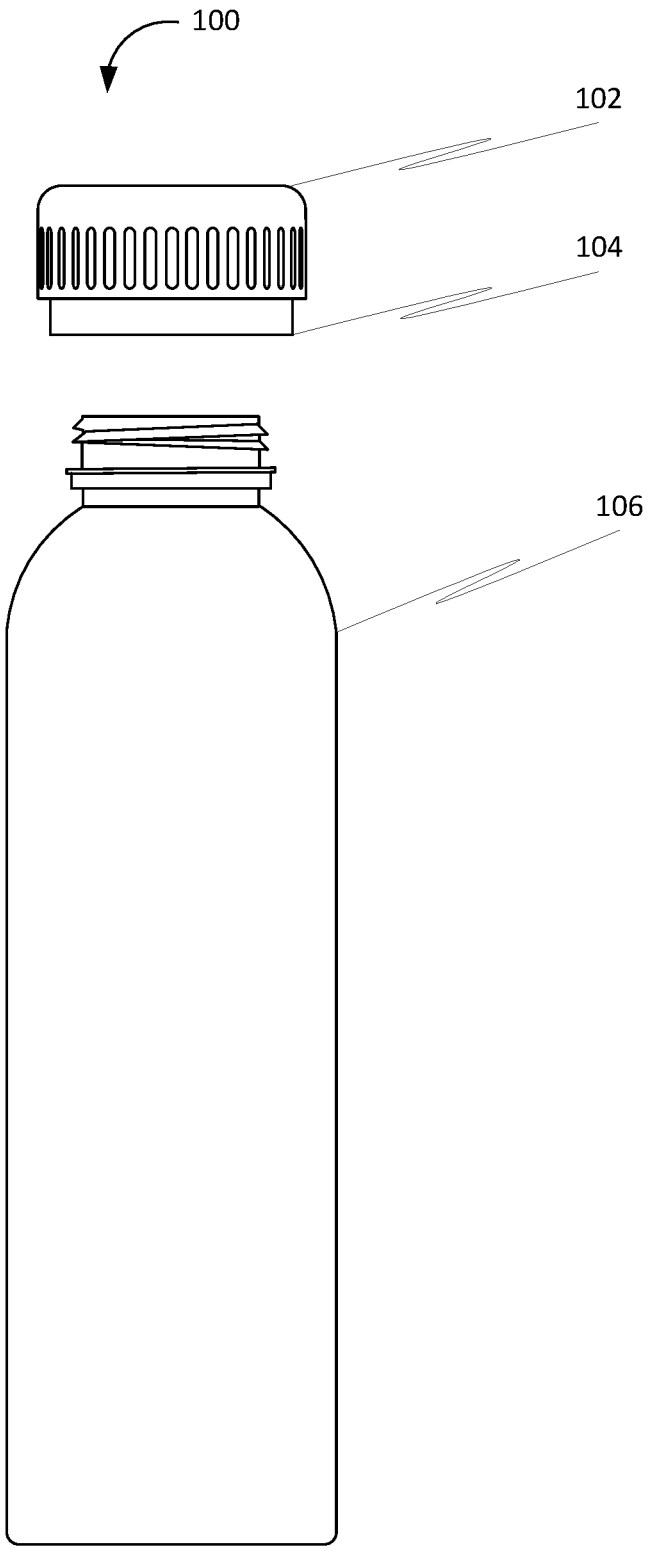
FIG. 15 is a front view of the apparatus 100 uncoupled from the container 106, in accordance with some embodiments.

FIG. 15 is a front view of the apparatus 100 uncoupled from the container 106, in accordance with some embodiments.

Figure 16:
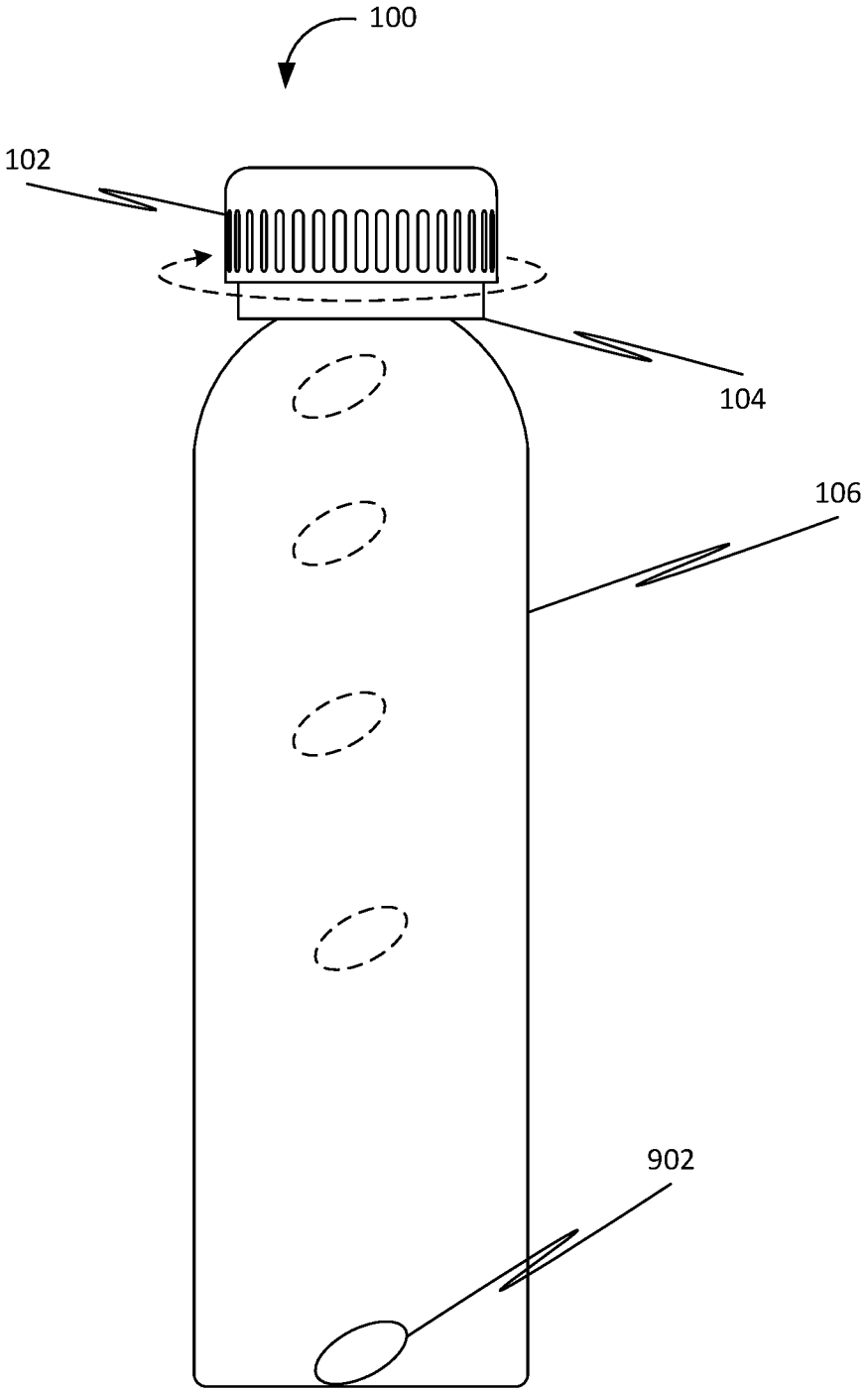
FIG. 16 is a front view of the apparatus 100 with the container 106, in accordance with some embodiments

FIG. 16 is a front view of the apparatus 100 with the container 106, in accordance with some embodiments. Accordingly, the one or more payloads 902 may be dispensed in the container 106 using the apparatus 100 based on the at least one external action received by the dispensing element 102 of the apparatus 100. Further, in some embodiments, the at least one external action may include but may not be limited to a twisting action on the dispensing element 102 in a clockwise direction.

FIG. 17 is an exploded view of the apparatus 100, in accordance with some embodiments. Further, the apparatus 100 may include the at least one seal creating element 1702.

Figure 18:
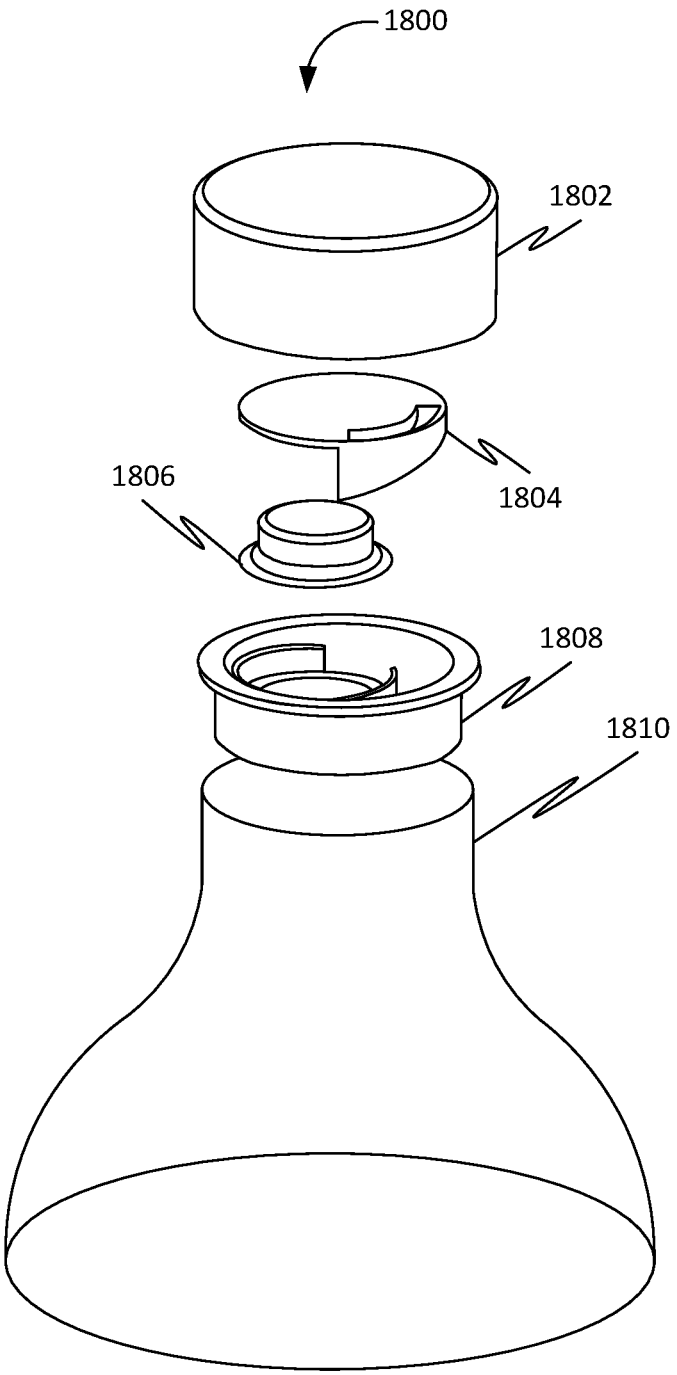
FIG. 18 is an exploded view of an apparatus 1800 for facilitating dispensing payloads into a container 1810, in accordance with some embodiments.

FIG. 18 is an exploded view of an apparatus 1800 for facilitating dispensing payloads into a container 1810, in accordance with some embodiments. Accordingly, the apparatus 1800 may include a cap 1802. Further, the apparatus 1800 may include a wedge 1804. Further, the apparatus 1800 may include a basket 1808. Further, a tablet holder 1806 may be placeable on the basket 1808.

Figure 19:
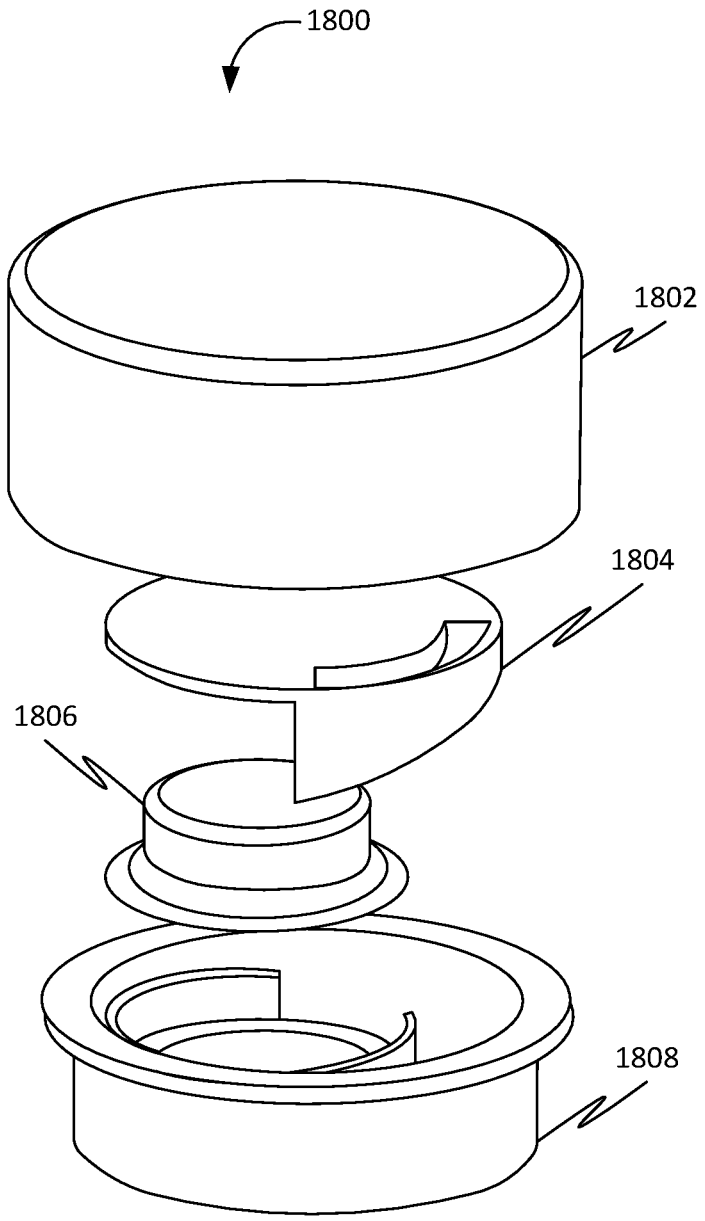
FIG. 19 is an exploded view of the apparatus 1800 without the container 1810, in accordance with some embodiments.

FIG. 19 is an exploded view of the apparatus 1800 without the container 1810, in accordance with some embodiments.

Figure 20:
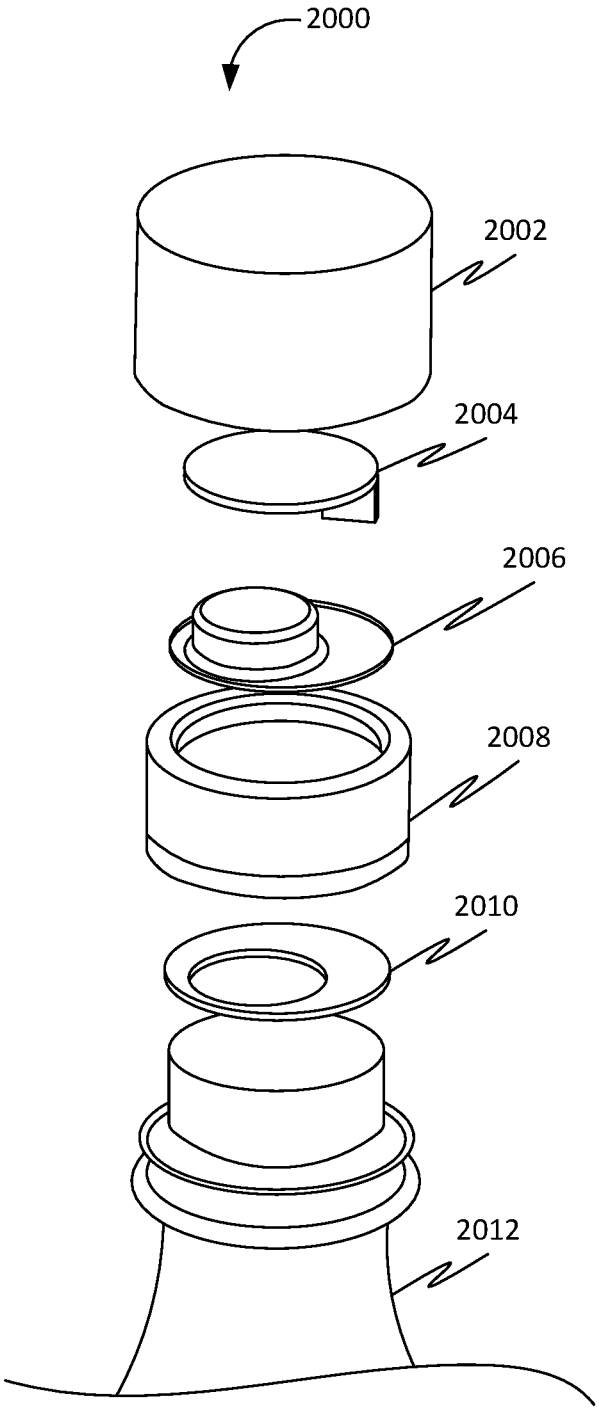
FIG. 20 is an exploded view of an apparatus 2000 facilitating dispensing payloads into a container 2012, in accordance with some embodiments.

FIG. 20 is an exploded view of an apparatus 2000 facilitating dispensing payloads into a container 2012, in accordance with some embodiments. Accordingly, the apparatus 2000 may include a cap 2002. Further, the apparatus 2000 may include a wedge 2004. Further, the apparatus 2000 may include a basket 2008. Further, a tablet holder 2006 may be placeable on the basket 2008. Further, the apparatus 2000 may include a base 2010.

Figure 21:
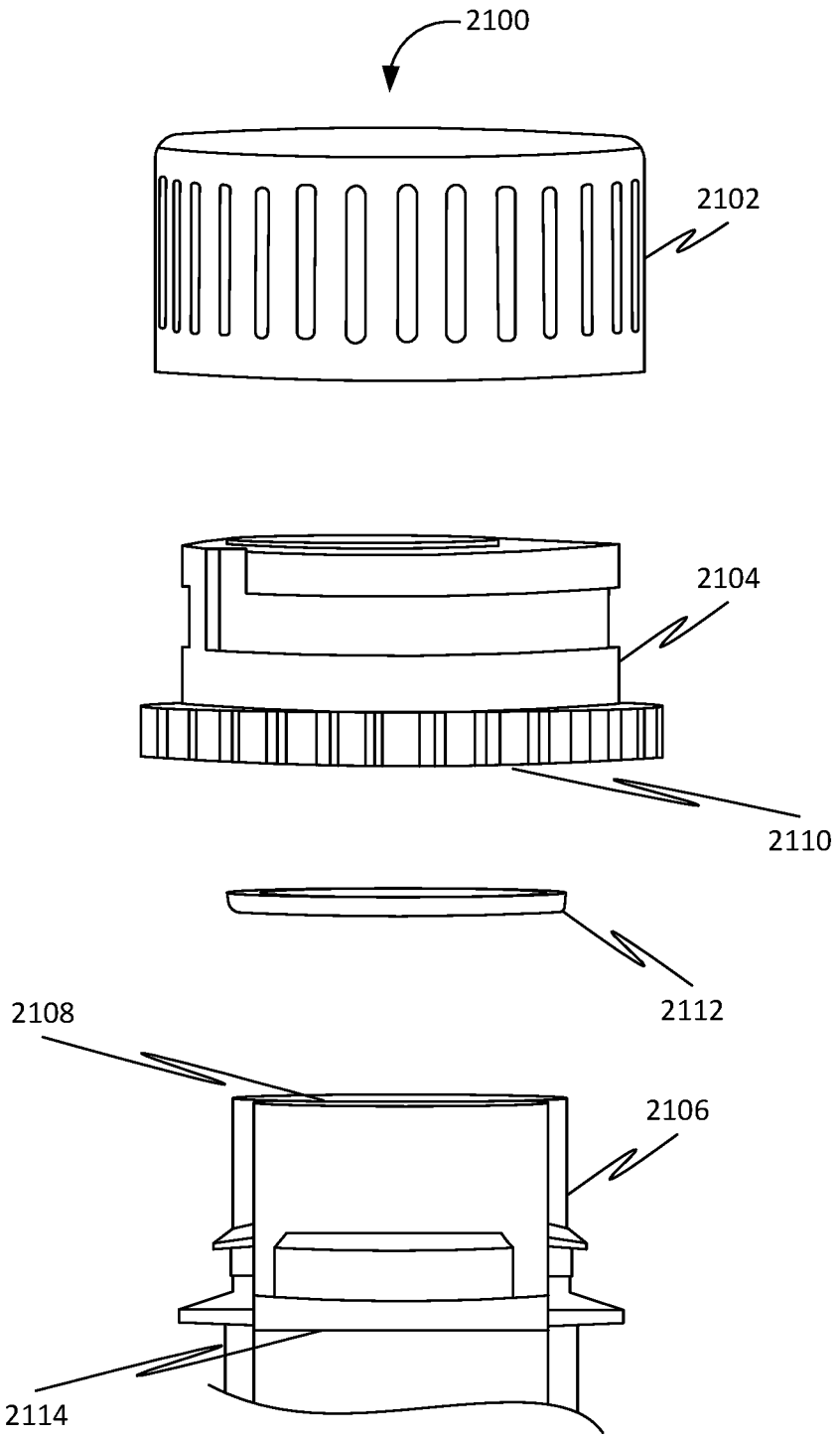
FIG. 21 is an exploded view of an apparatus 2100 for facilitating dispensing payloads into a container 2106, in accordance with some embodiments.

FIG. 21 is an exploded view of an apparatus 2100 for facilitating dispensing payloads into a container 2106, in accordance with some embodiments. Further, the apparatus 2100 may be couplable with an opening 2108 of the container 2106. Further, the opening 2108 leads into an interior of the container 2106. Further, the apparatus 2100 may include a placing element 2104 coupled with the opening 2108 of the container 2106 based on the coupling of the apparatus 2100. Further, the placing element 2104 may include one or more first openings 2110 fluidly coupled with the opening 2108 based on the coupling of the placing element 2104. Further, the placing element 2104 defines one or more payload receptacles on a top side of the placing element 2104. Further, the one or more payload receptacles may be disposed around the one or more first openings 2110. Further, the one or more payload receptacles define one or more recesses for receiving one or more payload holders that may include one or more payloads. Further, the one or more payload holders may include one or more breakable layers for releasably securing the one or more payloads into the one or more payload holders. Further, the one or more breakable layers oppose the one or more first openings 2110 based on the receiving. Further, the placing element 2104 may be configurable for creating a seal between the placing element 2104 and a periphery of the opening 2108 using at least one seal creating element 2112 based on the coupling of the placing element 2104. Further, the apparatus 2100 may include a dispensing element 2102 coupled with the placing element 2104. Further, the dispensing element 2102 may be configured for transitioning from a first position to at least one second position in relation to the placing element 2104 based on at least one external action receivable by the dispensing element 2102. Further, the dispensing element 2102 may include a pressing element disposed on a bottom side of the dispensing element 2102. Further, the pressing element may be configured for pressing the one or more payload holders with at least one amount of force based on the transitioning. Further, the pressing of the one or more payload holders breaks the one or more breakable layers for releasing the one or more payloads from the one or more payload holders. Further, the one or more payloads pass through the one or more first openings 2110 for dispensing the one or more payloads into the interior of the container 2106 based on the releasing.

Further, in some embodiments, the placing element 2104 may include a top wall and a side wall peripherally disposed around the top wall defining an interior space and an opening on a bottom side of the placing element 2104. Further, the placing element 2104 may be configured for receiving at least a portion of a container portion 2114 of the container 2106 in the interior space of the placing element 2104 through the opening of the placing element 2104 based on the coupling of the placing element 2104. Further, the container portion 2114 defines the opening 2108 of the container 2106.

Further, in some embodiments, the placing element 2104 may include at least one protrusion disposed on an inner surface of the side wall. Further, the at least one protrusion may be configured for engaging with at least one channel disposed on an outer surface of the container portion 2114. Further, the coupling of the placing element 2104 may be based on the engaging.

Further, in some embodiments, the dispensing element 2102 may include a top wall and a side wall peripherally disposed around the top wall defining an interior space and an opening in the bottom side of the dispensing element 2102. Further, the dispensing element 2102 receives at least a part of the placing element 2104 in the interior space of the dispensing element 2102 through the opening of the dispensing element 2102 based on the coupling of the dispensing element 2102 with the placing element 2104.

Further, in some embodiments, the dispensing element 2102 may include a protrusion disposed on an inner surface of the side wall of the dispensing element 2102. Further, the protrusion of the dispensing element 2102 movably engages with a channel comprised in an outer surface of the side wall of the placing element 2104. Further, the coupling of the dispensing element 2102 with the placing element 2104 may be based on the movably engaging of the protrusion of the dispensing element 2102 with the channel of the placing element 2104.

Further, in some embodiments, the placing element 2104 may be configured to be removably coupled with the opening 2108 of the container 2106 for transitioning between a closed state and at least one open state for openably closing the opening 2108 of the container 2106.

Further, in some embodiments, the dispensing element 2102 may be configured to be disengagedly engaged with the placing element 2104 for transitioning between an engaged state and a disengaged state. Further, the dispensing element 2102 may be configured for transitioning between a first state and at least one second state based on at least one first action receivable by the dispensing element 2102. Further, the transitioning of the dispensing element 2102 corresponds to the transitioning of the placing element 2104 in the engaged state. Further, the transitioning of the dispensing element 2102 does not correspond to the transitioning of the placing element 2104 in the disengaged state.

Further, in some embodiments, the dispensing element 2102 may be removably coupled with the placing element 2104 for transitioning between a closed state and at least one open state for openably closing the one or more payload receptacles. Further, the one or more payload receptacles may be accessible for the receiving of the one or more payload holders in the at least one open state. Further, the one or more payload receptacles may be not accessible for the receiving of the one or more payload holders in the closed state.

Figure 22:
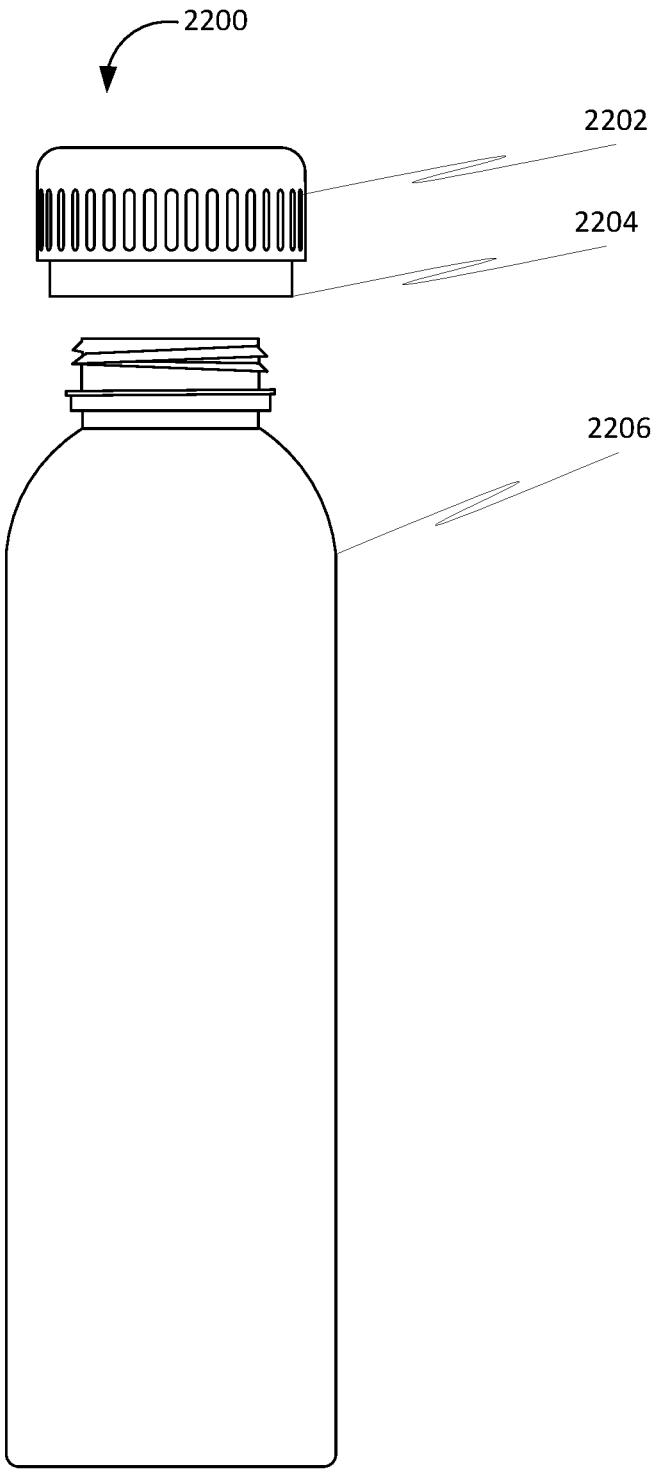
FIG. 22 is an exploded view of an apparatus 2200 for facilitating dispensing payloads into a container 2206, in accordance with some embodiments.

FIG. 22 is an exploded view of an apparatus 2200 for facilitating dispensing payloads into a container 2206, in accordance with some embodiments. Accordingly, the apparatus 2200 may include the container 2206. Further, the container 2206 may include an interior and an opening leading into the interior of the container 2206. Further, the apparatus 2200 may include a placing element 2204 coupled with the opening of the container 2206 based on the coupling of the apparatus 2200. Further, the placing element 2204 may include one or more first openings fluidly coupled with the opening based on the coupling of the placing element 2204. Further, the placing element 2204 defines one or more payload receptacles on a top side of the placing element 2204. Further, the one or more payload receptacles may be disposed around the one or more first openings. Further, the one or more payload receptacles define one or more recesses for receiving one or more payload holders that may include one or more payloads. Further, the one or more payload holders may include one or more breakable layers for releasably securing the one or more payloads into the one or more payload holders. Further, the one or more breakable layers oppose the one or more first openings based on the receiving. Further, the apparatus 2200 may include a dispensing element 2202 coupled with the placing element 2204. Further, the dispensing element 2202 may be configured for transitioning from a first position to at least one second position in relation to the placing element 2204 based on at least one external action receivable by the dispensing element 2202. Further, the dispensing element 2202 may include a pressing element disposed on a bottom side of the dispensing element 2202. Further, the pressing element may be configured for pressing the one or more payload holders with at least one amount of force based on the transitioning. Further, the pressing of the one or more payload holders breaks the one or more breakable layers for releasing the one or more payloads from the one or more payload holders. Further, the one or more payloads pass through the one or more first openings for dispensing the one or more payloads into the interior of the container 2206 based on the releasing.

Although the present disclosure has been explained in relation to its preferred embodiment, it is to be understood that many other possible modifications and variations can be made without departing from the spirit and scope of the disclosure.

The following is claimed:

1. An apparatus for facilitating dispensing payloads into a container, wherein the apparatus is couplable with an opening of the container, wherein the opening leads into an interior of the container, wherein the apparatus comprises:

a placing element coupled with the opening of the container based on the coupling of the apparatus, wherein the placing element comprises one or more first openings fluidly coupled with the opening based on the coupling of the placing element, wherein the placing element defines one or more payload receptacles on a top side of the placing element, wherein the one or more payload receptacles is disposed around the one or more first openings, wherein the one or more payload receptacles defines one or more recesses for receiving one or more payload holders comprising one or more payloads, wherein the one or more payload holders comprises one or more breakable layers for releasably securing the one or more payloads into the one or more payload holders, wherein the one or more breakable layers opposes the one or more first openings based on the receiving; and a dispensing element coupled with the placing element, wherein the dispensing element is configured for transitioning from a first position to at least one second position in relation to the placing element based on at least one external action receivable by the dispensing element, wherein the dispensing element comprises a pressing element disposed on a bottom side of the dispensing element, wherein the pressing element is configured for pressing the one or more payload holders with at least one amount of force based on the transitioning, wherein the pressing element is a wedge, wherein the at least one external action comprises a twisting action in at least one of a clockwise direction and a counterclockwise direction up to at least one degree of rotation, wherein the at least one degree of rotation comprises at most 180 degrees of rotation, wherein the dispensing element rotates based on the at least one external action rotating the wedge, wherein the wedge moves into the one or more payload holders for the pressing of the one or more payload holders based on the rotating of the wedge, wherein the pressing of the one or more payload holders breaks the one or more breakable layers for releasing the one or more payloads from the one or more payload holders, wherein the one or more payloads passes through the one or more first openings for dispensing the one or more payloads into the interior of the container based on the releasing.

2. The apparatus of claim 1, wherein the placing element comprises a top wall and a side wall peripherally disposed around the top wall defining an interior space and an opening on a bottom side of the placing element, wherein the placing element is configured for receiving at least a portion of a container portion of the container in the interior space of the placing element through the opening of the placing element based on the coupling of the placing element, wherein the container portion defines the opening of the container.

3. The apparatus of claim 2, wherein the placing element comprises at least one protrusion disposed on an inner surface of the side wall, wherein the at least one protrusion is configured for engaging with at least one channel disposed on an outer surface of the container portion, wherein the coupling of the placing element is based on the engaging.

4. The apparatus of claim 2, wherein the dispensing element comprises a top wall and a side wall peripherally disposed around the top wall defining an interior space and an opening in the bottom side of the dispensing element, wherein the dispensing element receives at least a part of the placing element in the interior space of the dispensing element through the opening of the dispensing element based on the coupling of the dispensing element with the placing element.

5. The apparatus of claim 4, wherein the dispensing element comprises a protrusion disposed on an inner surface of the side wall of the dispensing element, wherein the protrusion of the dispensing element movably engages with a channel comprised in an outer surface of the side wall of the placing element, wherein the coupling of the dispensing element with the placing element is based on the movably engaging of the protrusion of the dispensing element with the channel of the placing element.

6. The apparatus of claim 5, wherein the coupling of the dispensing element with the placing element positions the protrusion in an initial position in the channel of the placing element, wherein the transitioning of the dispensing element from the first position to the at least one second position is based on the positioning of the protrusion in the initial position.

7. The apparatus of claim 6, wherein the transitioning of the dispensing element from the first position to the at least one second position comprises moving the protrusion from the initial position in the channel of the placing element to at least one final position in the channel of the placing element, wherein the pressing of the one or more payload holders with the at least one amount of force is based on the moving of the protrusion from the initial position in the channel of the placing element to the at least one final position in the channel of the placing element.

8. The apparatus of claim 1, wherein the placing element is configured to be removably coupled with the opening of the container for transitioning between a closed state and at least one open state for openably closing the opening of the container, wherein the placing element is comprised of at least one soft material having stickiness, wherein the placing element forms an interference fit with the container.

9. The apparatus of claim 8, wherein the dispensing element is configured to be disengagedly engaged with the placing element for transitioning between an engaged state and a disengaged state, wherein the dispensing element is configured for transitioning between a first state and at least one second state based on at least one first action receivable by the dispensing element, wherein the transitioning of the dispensing element corresponds to the transitioning of the placing element in the engaged state, wherein the transitioning of the dispensing element does not correspond to the transitioning of the placing element in the disengaged state.

10. The apparatus of claim 1, wherein the dispensing element is removably coupled with the placing element for transitioning between a closed state and at least one open state for openably closing the one or more payload receptacles, wherein the one or more payload receptacles is accessible for the receiving of the one or more payload holders in the at least one open state, wherein the one or more payload receptacles is not accessible for the receiving of the one or more payload holders in the closed state.

11. The apparatus of claim 1, wherein the placing element is configurable for creating a seal between the placing element and a periphery of the opening using at least one seal creating element based on the coupling of the placing element, wherein the at least one seal creating element is a wadding disposed on a bottom side of the placing element for the creating of the seal, wherein the seal comprises at least one of a water-tight seal and an airtight seal.

12. An apparatus for facilitating dispensing payloads into a container, wherein the apparatus is couplable with an opening of the container, wherein the opening leads into an interior of the container, wherein the apparatus comprises:

a placing element coupled with the opening of the container based on the coupling of the apparatus, wherein the placing element comprises one or more first openings fluidly coupled with the opening based on the coupling of the placing element, wherein the placing element defines one or more payload receptacles on a top side of the placing element, wherein the one or more payload receptacles is disposed around the one or more first openings, wherein the one or more payload receptacles defines one or more recesses for receiving one or more payload holders comprising one or more payloads, wherein the one or more payload holders comprises one or more breakable layers for releasably securing the one or more payloads into the one or more payload holders, wherein the one or more breakable layers opposes the one or more first openings based on the receiving, wherein the placing element is configurable for creating a seal between the placing element and a periphery of the opening using at least one seal creating element based on the coupling of the placing element, wherein the at least one seal creating element is a wadding disposed on a bottom side of the placing element for the creating of the seal, wherein the seal comprises at least one of a water-tight seal and an airtight seal; and a dispensing element coupled with the placing element, wherein the dispensing element is configured for transitioning from a first position to at least one second position in relation to the placing element based on at least one external action receivable by the dispensing element, wherein the dispensing element comprises a pressing element disposed on a bottom side of the dispensing element, wherein the pressing element is configured for pressing the one or more payload holders with at least one amount of force based on the transitioning, wherein the pressing element is a wedge, wherein the at least one external action comprises a twisting action in at least one of a clockwise direction and a counterclockwise direction up to at least one degree of rotation, wherein the at least one degree of rotation comprises at most 180 degrees of rotation, wherein the dispensing element rotates based on the at least one external action rotating the wedge, wherein the wedge moves into the one or more payload holders for the pressing of the one or more payload holders based on the rotating of the wedge, wherein the pressing of the one or more payload holders breaks the one or more breakable layers for releasing the one or more payloads from the one or more payload holders, wherein the one or more payloads passes through the one or more first openings for dispensing the one or more payloads into the interior of the container based on the releasing.

13. The apparatus of claim 12, wherein the placing element comprises a top wall and a side wall peripherally disposed around the top wall defining an interior space and an opening on a bottom side of the placing element, wherein the placing element is configured for receiving at least a portion of a container portion of the container in the interior space of the placing element through the opening of the placing element based on the coupling of the placing element, wherein the container portion defines the opening of the container.

14. The apparatus of claim 13, wherein the placing element comprises at least one protrusion disposed on an inner surface of the side wall, wherein the at least one protrusion is configured for engaging with at least one channel disposed on an outer surface of the container portion, wherein the coupling of the placing element is based on the engaging.

15. The apparatus of claim 13, wherein the dispensing element comprises a top wall and a side wall peripherally disposed around the top wall defining an interior space and an opening in the bottom side of the dispensing element, wherein the dispensing element receives at least a part of the placing element in the interior space of the dispensing element through the opening of the dispensing element based on the coupling of the dispensing element with the placing element.

16. The apparatus of claim 15, wherein the dispensing element comprises a protrusion disposed on an inner surface of the side wall of the dispensing element, wherein the protrusion of the dispensing element movably engages with a channel comprised in an outer surface of the side wall of the placing element, wherein the coupling of the dispensing element with the placing element is based on the movably engaging of the protrusion of the dispensing element with the channel of the placing element.

17. The apparatus of claim 12, wherein the placing element is configured to be removably coupled with the opening of the container for transitioning between a closed state and at least one open state for openably closing the opening of the container, wherein the placing element is comprised of at least one soft material having stickiness, wherein the placing element forms an interference fit with the container.

18. The apparatus of claim 17, wherein the dispensing element is configured to be disengagedly engaged with the placing element for transitioning between an engaged state and a disengaged state, wherein the dispensing element is configured for transitioning between a first state and at least one second state based on at least one first action receivable by the dispensing element, wherein the transitioning of the dispensing element corresponds to the transitioning of the placing element in the engaged state, wherein the transitioning of the dispensing element does not correspond to the transitioning of the placing element in the disengaged state.

19. The apparatus of claim 12, wherein the dispensing element is removably coupled with the placing element for transitioning between a closed state and at least one open state for openably closing the one or more payload receptacles, wherein the one or more payload receptacles is accessible for the receiving of the one or more payload holders in the at least one open state, wherein the one or more payload receptacles is not accessible for the receiving of the one or more payload holders in the closed state.

20. An apparatus facilitating dispensing payloads into a container, the apparatus comprising:

the container comprising an interior and an opening leading into the interior of the container;

a placing element coupled with the opening of the container based on the coupling of the apparatus, wherein the placing element comprises one or more first openings fluidly coupled with the opening based on the coupling of the placing element, wherein the placing element defines one or more payload receptacles on a top side of the placing element, wherein the one or more payload receptacles is disposed around the one or more first openings, wherein the one or more payload receptacles defines one or more recesses for receiving one or more payload holders comprising one or more payloads, wherein the one or more payload holders comprises one or more breakable layers for releasably securing the one or more payloads into the one or more payload holders, wherein the one or more breakable layers opposes the one or more first openings based on the receiving, wherein the placing element is configurable for creating a seal between the placing element and a periphery of the opening using at least one seal creating element based on the coupling of the placing element, wherein the at least one seal creating element is a wadding disposed on a bottom side of the placing element for the creating of the seal, wherein the seal comprises at least one of a water-tight seal and an airtight seal, wherein the placing element is configured to be removably coupled with the opening of the container for transitioning between a closed state and at least one open state for openably closing the opening of the container, wherein the placing element is comprised of at least one soft material having stickiness, wherein the placing element forms an interference fit with the container; and a dispensing element coupled with the placing element, wherein the dispensing element is configured for transitioning from a first position to at least one second position in relation to the placing element based on at least one external action receivable by the dispensing element, wherein the dispensing element comprises a pressing element disposed on a bottom side of the dispensing element, wherein the pressing element is configured for pressing the one or more payload holders with at least one amount of force based on the transitioning, wherein the pressing element is a wedge, wherein the at least one external action comprises a twisting action in at least one of a clockwise direction and a counterclockwise direction up to at least one degree of rotation, wherein the at least one degree of rotation comprises at most 180 degrees of rotation, wherein the dispensing element rotates based on the at least one external action rotating the wedge, wherein the wedge moves into the one or more payload holders for the pressing of the one or more payload holders based on the rotating of the wedge, wherein the pressing of the one or more payload holders breaks the one or more breakable layers for releasing the one or more payloads from the one or more payload holders, wherein the one or more payloads passes through the one or more first openings for dispensing the one or more payloads into the interior of the container based on the releasing.

* * * * *